US008596777B2

(12) United States Patent
Okamoto

(10) Patent No.: US 8,596,777 B2
(45) Date of Patent: Dec. 3, 2013

(54) LIQUID EJECTING APPARATUS

(75) Inventor: Katsumi Okamoto, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 288 days.

(21) Appl. No.: 13/096,532

(22) Filed: Apr. 28, 2011

(65) Prior Publication Data

US 2011/0267393 A1 Nov. 3, 2011

(30) Foreign Application Priority Data

Apr. 30, 2010 (JP) ..... 2010-104922
May 7, 2010 (JP) ..... 2010-107173

(51) Int. Cl.
*B41J 2/01* (2006.01)

(52) U.S. Cl.
USPC ..... 347/102; 347/14

(58) Field of Classification Search
USPC ..... 347/14, 102
See application file for complete search history.

(56) References Cited

U.S. PATENT DOCUMENTS 3,934,112 A * 1/1976 Lakhani ..... 219/216
5,614,928 A * 3/1997 Matsuda ..... 347/2
6,511,147 B2 * 1/2003 Kubota et al. ..... 347/16
6,530,657 B2 * 3/2003 Polierer ..... 347/102
2004/0189773 A1 * 9/2004 Masumi et al. ..... 347/102

FOREIGN PATENT DOCUMENTS

JP 2001-334647 A 12/2001
JP 2004-276437 A 10/2004

OTHER PUBLICATIONS

English Machine Translation of JP 2001-334647.*

* cited by examiner

*Primary Examiner* — Julian Huffman
*Assistant Examiner* — Sharon A Polk
(74) *Attorney, Agent, or Firm* — Workman Nydegger

(57) ABSTRACT

A printer includes a heating roller unit that heats recording paper at a position downstream of a recording head, which is provided at an upstream position, in the direction of the transportation of the recording paper. The recording head ejects ink to the recording paper that is transported from an upstream side to a downstream side. The heating roller unit is disposed along the direction of the width of the recording paper, which intersects with the transportation direction thereof. The heating roller unit is divided into a plurality of areas in the width direction. Heat applied by first areas of the plurality of areas to the recording paper is different from heat applied by second areas, which are adjacent to the first areas in the width direction, to the recording paper.

15 Claims, 12 Drawing Sheets

LIQUID EJECTING APPARATUS

CROSS REFERENCE TO RELATED APPLICATIONS

This application claims the benefit of Japanese Patent Application No: 2010-104922 filed Apr. 30, 2010 and 2010-107173 filed May 7, 2010, the contents of which are hereby incorporated by reference in their entirety.

BACKGROUND

1. Technical Field

The present invention relates to a liquid ejecting apparatus.

2. Related Art

An ink-jet printer is well known as a kind of a liquid ejecting apparatus. An ink-jet printer ejects ink (liquid) supplied to a recording head (liquid ejecting head) through nozzles, which are formed in the recording head, onto a recording target medium such as paper, thereby printing an image thereon. Some of ink-jet printers are equipped with a heating means that applies heat to ink ejected for printing onto a recording target medium during the transportation of the recording target medium so as to dry it (for example, refer to JP-A-2004-276437). Another known ink-jet printer is equipped with a drying means that blows warm air to ink ejected for printing onto a recording target medium during the transportation of the recording target medium so as to dry it (for example, refer to JP-A-2001-334647).

In the printer disclosed in JP-A-2004-276437, a heating roller that can rotate while being in contact with the image-printed surface of a recording target medium, that is, the surface on which recording operation has been performed, to transport the recording target medium is provided at a position downstream of a recording head, which is provided at an upstream position, in the direction of the transportation of the recording target medium. A plurality of heat generators is provided inside the heating roller along the direction of the shaft thereof. Control is carried out to switch active heat generators, which are used for heat generation, on the basis of the size of a recording target medium in the width direction, which is perpendicular to the transportation direction. In other words, a limited region of the heating roller, specifically, a region with which the image-printed surface of a recording target medium that is transported as a heating target is brought into contact, is actuated for heat generation. With the generation of heat at such a limited region, it is possible to dry the recording target medium during transportation efficiently. In the printer disclosed in JP-A-2001-334647, a drying means is disposed downstream of a recording head in the direction of the transportation of a recording target medium. The drying means has an opening for blowing warm air. The warm air outlet is elongated in the width direction, which is perpendicular to the transportation direction. The drying means blows warm air from the warm air outlet in an inclined direction with respect to the direction of transportation of a recording target medium. Therefore, the flowing of warm air from the drying means to the recording head is suppressed.

In the printer disclosed in JP-A-2004-276437, heat is uniformly applied to the entire surface of a recording target medium that is transported for drying it. Because of uniform heat application, the recording target medium curls up in the transportation direction when dried. For this reason, there is a risk of a transportation failure such as a paper jam.

In the printer disclosed in JP-A-2001-334647, since warm air is blown from the warm air outlet of the drying means to a recording target medium throughout the entire surface thereof in the width direction, the level of dryness of the surface of the recording target medium after the drying process is uniform. Therefore, as in the printer disclosed in JP-A-2004-276437, the recording target medium curls up in the transportation direction when dried. For this reason, there is a risk of a transportation failure such as a paper jam.

SUMMARY

An advantage of some aspects of the invention is to provide a liquid ejecting apparatus that can reduce the curling of a recording target medium in the direction of the transportation thereof in a drying process.

A liquid ejecting apparatus that ejects liquid to a recording target medium that is transported from an upstream side to a downstream side is provided. A liquid ejecting apparatus according to a first aspect of the invention includes a liquid ejecting head and a heating section. The liquid ejecting head ejects the liquid to the recording target medium for recording. The heating section heats the recording target medium at a downstream position in a transportation direction of the recording target medium. The heating section is disposed along a width direction of the recording target medium, which intersects with the transportation direction thereof. The heating section is divided into a plurality of areas in the width direction. Heat applied by first areas of the plurality of areas to the recording target medium is different from heat applied by second areas, which are adjacent to the first areas in the width direction, to the recording target medium.

With such a configuration, since heat applied to the surface of a recording target medium is in non-uniform distribution in the direction of the width thereof, which is perpendicular to the direction of the transportation thereof, it is possible to make the levels of dryness of the recording target medium different in the direction of the width thereof. By this means, it is possible to avoid the recording target medium from curling, or reduce a curl, in the direction of the transportation thereof.

In a liquid ejecting apparatus according to the first aspect of the invention, it is preferable that the heating section should be a heating roller that rotates while being in contact with the recording target medium to transport the recording target medium.

With such a preferred configuration, since a roller that transports a recording target medium can be used as the heating section, a space for providing a dedicated means for heating the recording target medium is not necessary. Therefore, it is possible to reduce the size of the apparatus.

Preferably, the above liquid ejecting apparatus should further include a controlling section, wherein the heating roller includes a plurality of heat generators arranged inside the heating roller in the width direction; and the controlling section controls a heat generation state of each of the plurality of heat generators in such a way as to make heat applied by heat generators corresponding to the first areas different from heat applied by heat generators corresponding to the second areas.

With such a preferred configuration, it is possible to control a difference in the levels of dryness of a recording target medium in the direction of the width thereof by controlling heat applied to the surface of the recording target medium in the direction of the width thereof. By this means, it is possible to reduce the curling of a recording target medium in the direction of the transportation thereof more effectively.

In the above liquid ejecting apparatus, preferably, the controlling section should control the heat applied by the first areas of the heating roller and the heat applied by the second areas of the heating roller on the basis of image data for an image to be recorded on the recording target medium.

With such a preferred configuration, since heat applied by the first areas of the heating section and heat applied by the second areas thereof are controlled on the basis of the amount of liquid ejected onto a recording target medium, a difference in the levels of dryness of the recording target medium can be controlled properly. By this means, it is possible to reduce the curling of the recording target medium in the direction of the transportation thereof in a drying process with proper control.

In the above liquid ejecting apparatus, preferably, the heating roller should include a rotating shaft that is disposed along the width direction and a plurality of roller body members provided on the rotating shaft at intervals in a shaft direction for contact with the recording target medium.

In such a preferred configuration, heat applied to the surface of a recording target medium is in non-uniform distribution in the direction of the width thereof because of the presence of the plurality of roller body members provided on the rotating shaft at intervals in a shaft direction and regions between the roller body members. Therefore, the levels of dryness of a recording target medium can be made different in the direction of the width thereof easily. Thus, the curling of the recording target medium in the direction of the transportation thereof in a drying process can be reduced easily.

In the above liquid ejecting apparatus, preferably, the heating roller should be a pair of a first roller and a second roller; a surface of the recording target medium on which the liquid has been ejected should be brought into contact with the first roller; a surface opposite to the surface that is brought into contact with the first roller should be brought into contact with the second roller; the recording target medium should be pinched between the first roller and the second roller for transportation when in contact therewith; and heat applied by the first roller to the recording target medium should be higher than heat applied by the second roller to the recording target medium.

With such a preferred configuration, it is possible to make, on both surfaces, the levels of dryness of a recording target medium different in the direction of the width thereof. In addition, it is possible to apply heat to liquid ejected onto the recording target medium for drying it efficiently by setting the heat applied to a surface of the recording target medium on which the liquid has been ejected at a relatively large value. By this means, it is possible to reduce the curling of the recording target medium in the direction of the transportation thereof in a drying process more effectively.

In a liquid ejecting apparatus according to the first aspect of the invention, it is preferable that the heating section should be a drying device that blows warm air to a surface of the recording target medium that is wet with the liquid.

With such a preferred configuration, since heat applied to the surface of a recording target medium due to warm air blown by the drying device is in non-uniform distribution in the direction of the width thereof, which is perpendicular to the direction of the transportation thereof, it is possible to make the levels of dryness of the recording target medium different in the direction of the width thereof. By this means, it is possible to reduce the curling of the recording target medium in the direction of the transportation thereof in a drying process.

In the above liquid ejecting apparatus, preferably, the drying device should include a plurality of air-sending passages for separating the warm air into a plurality of air currents corresponding to the plurality of areas.

With such a preferred configuration, it is possible to easily form a plurality of air currents separated from one another in the width direction at the drying device.

It is preferable that the above liquid ejecting apparatus should further include a controlling section that controls the drying device in such a way as to make heat applied by first air currents of the plurality of air currents blown from the plurality of air-sending passages to the first areas different from heat applied by second air currents thereof to the second areas.

With such a preferred configuration, since heat applied to the surface of a recording target medium due to warm air blown by the drying device is controlled, the levels of dryness of the recording target medium can be made different in the direction of the width thereof. By this means, it is possible to reduce the curling of a recording target medium in the direction of the transportation thereof more effectively.

In the above liquid ejecting apparatus, preferably, the drying device should include a plurality of heating members corresponding to the plurality of air-sending passages; and the controlling section should control amount of heat generation of the plurality of heating members.

With such a preferred configuration, it is possible to control a difference in the levels of dryness of a recording target medium in the direction of the width thereof by controlling the temperature of a plurality of air currents in the direction of the width thereof. By this means, it is possible to reduce the curling of the recording target medium in the direction of the transportation thereof in a drying process more effectively.

In the above liquid ejecting apparatus, preferably, the drying device should include a plurality of blowing members corresponding to the plurality of air-sending passages; and the controlling section should control operation of the plurality of blowing members.

With such a preferred configuration, it is possible to control a difference in the levels of dryness of a recording target medium in the direction of the width thereof by controlling the flow rate of a plurality of air currents in the direction of the width thereof. By this means, it is possible to reduce the curling of the recording target medium in the direction of the transportation thereof in a drying process more effectively.

It is preferable that the above liquid ejecting apparatus should further include a suction passage that is provided adjacent to the plurality of air-sending passages so as to collect the warm air blown from the plurality of air-sending passages.

With such a preferred configuration, the flowing of warm air blown by the drying device to the liquid ejecting head is suppressed, which results in a reduction in the turbulence of airflow at the liquid-ejecting-head side on a transportation path. Thus, it is possible to print an image on the recording target medium with high precision.

It is preferable that the above liquid ejecting apparatus should further include an air screen member that is disposed along the width direction at a position downstream of the liquid ejecting head but upstream of the drying device in the transportation direction so as to partially block a flow of the warm air from the drying device to the liquid ejecting head.

In such a preferred configuration, the air screen member substantially reduces the flow of warm air blown by the drying device toward the liquid ejecting head. Therefore, the turbulence of airflow at the liquid-ejecting-head side is reduced on the paper transportation path. Thus, it is possible to print an image on the recording target medium with high precision.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

With reference to FIGS. 1 to 4, an ink-jet printer according to an exemplary embodiment of the invention will now be explained in detail. The ink-jet printer described below is a kind of a liquid ejecting apparatus according to an aspect of the invention. The term "forward/backward direction" that appears in the following description of this specification mean the "from-back-to-front" direction (or "from-front-to-back" direction when viewed in the reverse orientation) (front/back) (depth) shown by an arrow in each of the accompanying drawings unless otherwise specified. The terms "horizontal direction" and "vertical direction" that appear in the following description of this specification mean the leftward/rightward (left/right) direction and the upward/downward (top/bottom) direction shown by arrows in each of the accompanying drawings unless otherwise specified.

Figure 1:
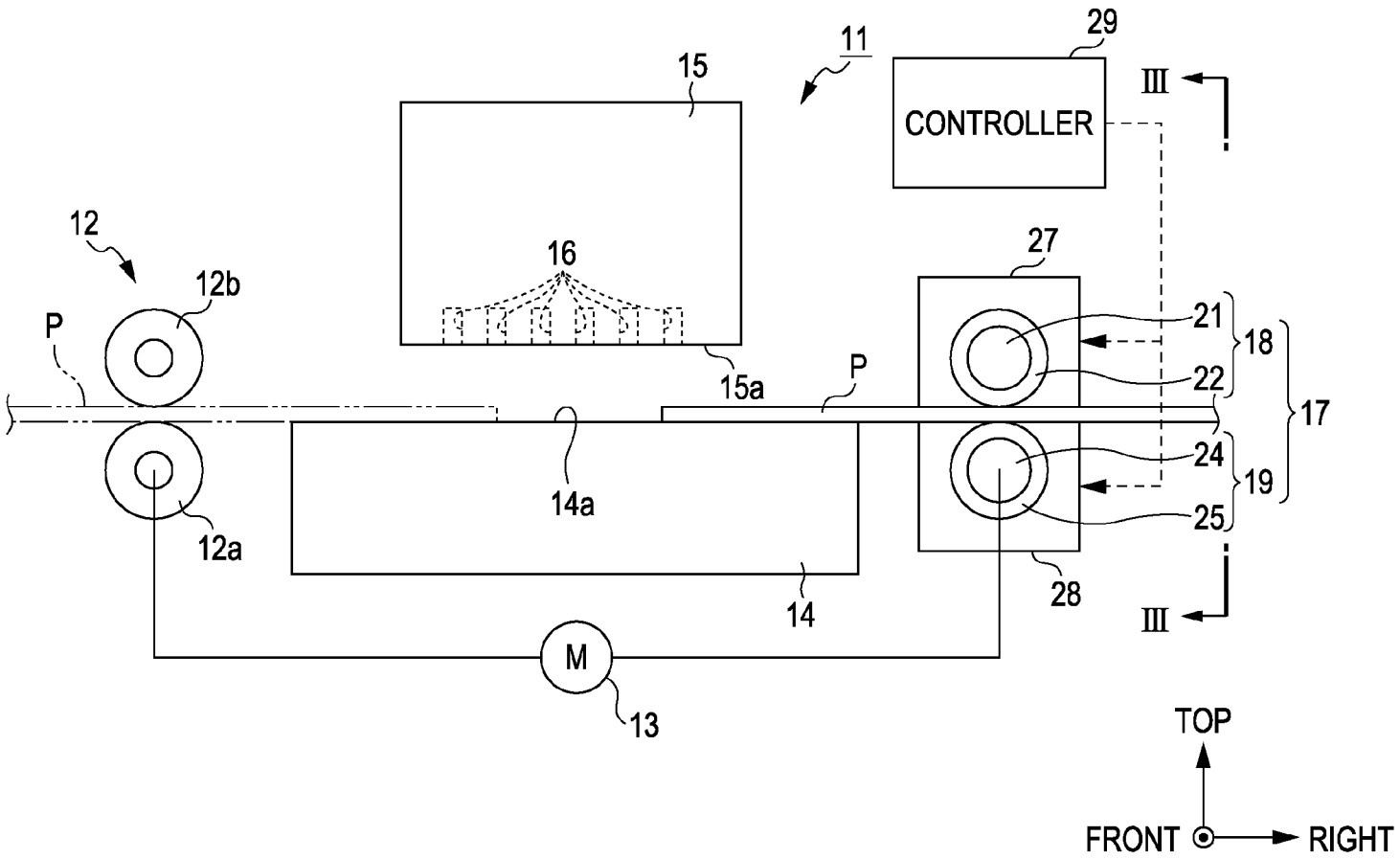
FIG. 1 is a front view that schematically illustrates an example of the structure of a printer according to a first embodiment of the invention.

As illustrated in FIG. 1, an ink-jet printer 11, which is an example of a liquid ejecting apparatus, has a pair of upper and lower paper-feed rollers 12. The pair of paper-feed rollers 12 transports recording paper P as an example of a recording target medium from the left, which is the upstream side, to the right, which is the downstream side, in a predetermined medium transportation direction (horizontal direction in the present embodiment). The pair of paper-feed rollers 12 is made up of a paper-feed driving roller 12*a*, which extends in the forward/backward direction (in the direction perpendicular to the sheet face of FIG. 1) and can rotate when driven by a driving motor 13, and a paper-feed driven roller 12*b*, which is provided opposite to the paper-feed driving roller 12*a* with the recording paper P therebetween. In a state in which the recording paper P is pinched between the paper-feed driving roller 12*a* and the paper-feed driven roller 12*b*, the paper-feed driven roller 12*b* rotates as a follower when the paper-feed driving roller 12*a* rotates. The pair of paper-feed rollers 12 transports the recording paper P to the downstream side in this way.

A platen 14, which supports the back of a sheet of recording paper P from below during transportation, is provided downstream of, that is, to the right of, the pair of paper-feed rollers 12 in the direction of the transportation of the recording paper P. The platen 14 has the shape of a rectangular plate having long sides in the direction of the width of the recording paper P (the forward/backward direction in the present embodiment), which is perpendicular to the direction of the transportation of the recording paper P. The recording paper P slides on a supporting surface 14*a*, which is the top of the platen 14, during transportation.

A recording head 15, which is an example of a liquid ejecting head, is provided over the platen 14. Specifically, the recording head 15 is fixed at a position where it faces the platen 14 with the recording paper P therebetween. The recording head 15 ejects ink, which is an example of liquid, onto the (upper) surface of the recording paper P that is transported along a paper transportation path. The recording head 15 is a full-line type line head that includes a head body having long sides in the direction perpendicular to the direction of the transportation of the recording paper P (having long sides in the forward/backward direction). The length thereof corresponds to the maximum sheet width of the recording paper P. The lower surface of the recording head 15 is a flat nozzle surface 15*a* through which a plurality of nozzles 16 for ejecting ink is formed. The nozzles 16 are arranged next to one another at equal spaces along the long sides of the recording head 15 (that is, in the forward/backward direction, which is the direction of the width of the recording paper P) to make up each of a plurality of nozzle lines (not shown). The nozzle lines are arranged next to one another at equal spaces in the direction of the transportation of the recording paper P. The recording head 15 ejects ink onto a sheet of recording paper P in synchronization with the passing of the recording paper P under the recording head 15, thereby printing an image by dot formation on the surface of the recording paper P.

A pair of upper and lower heating rollers 17 is provided downstream of, that is, to the right of, the platen 14 in the direction of the transportation of the recording paper P. The heating roller unit 17 transports the recording paper P on which recording operation has been performed by the recording head 15 to a paper-eject port (not shown) that is provided at the downstream side. In addition, the heating roller unit 17 heats the recording paper P. The heating roller unit 17 includes a heating driven roller 18 as a first roller and a heating driving roller 19 as a second roller. The front (upper surface) of the recording paper P, that is, the surface on which the image has been printed, is brought into contact with the heating driven roller 18 during transportation. The back (lower surface) of the recording paper P, that is, the surface opposite to the recorded surface, is brought into contact with the heating driving roller 19 during transportation.

Figure 2:
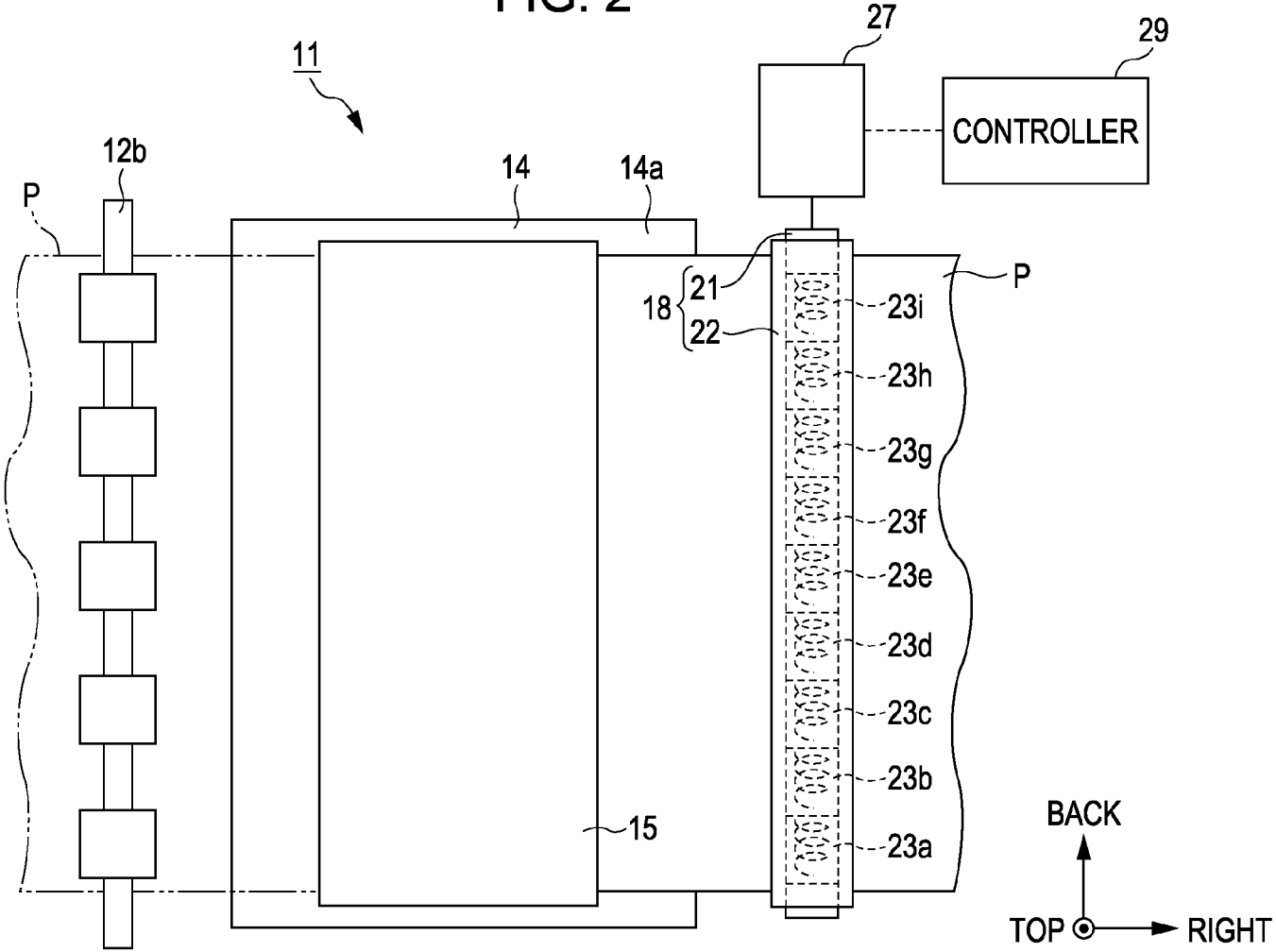
FIG. 2 is a plan view that schematically illustrates an example of the structure of a printer according to the first embodiment of the invention.
Figure 3:
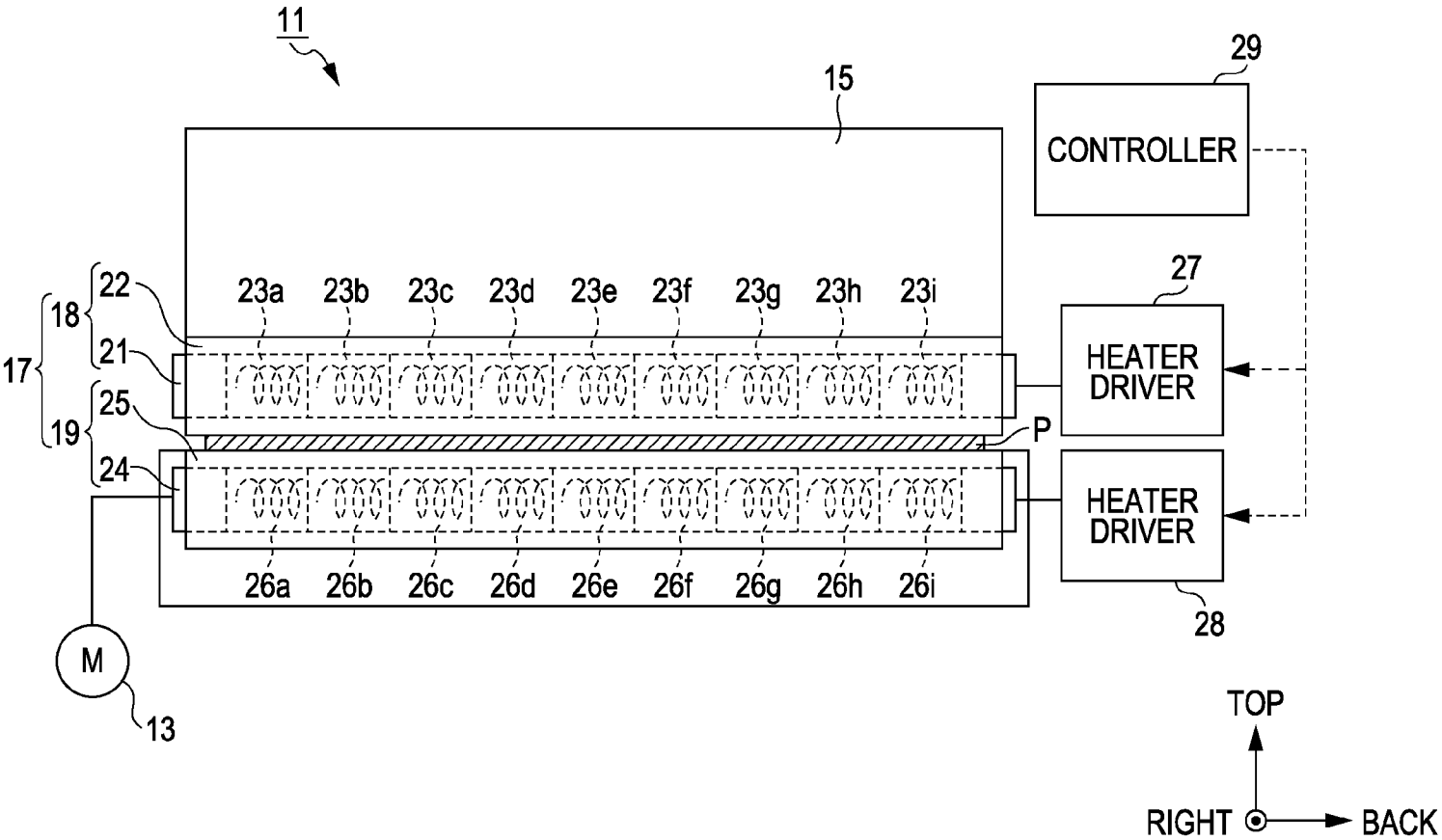
FIG. 3 is a sectional view taken along the line III-III of FIG. 1.

As illustrated in FIGS. 2 and 3, the heating driven roller 18 includes a driven roller shaft 21 and a driven roller part 22. The driven roller shaft 21 extends in the direction of the width of the recording paper P. The driven roller part 22, which also extends in the direction of the width of the recording paper P, has the shape of a cylinder that is provided on and supported by the driven roller shaft 21 and can rotate together with the driven roller shaft 21. A plurality of (in the present embodiment, nine) heaters 23*a* to 23*i* (e.g., sheath heaters), which is an example of a plurality of heat generators, is provided inside the driven roller shaft 21. The heaters 23*a* to 23*i* are arranged in series along the driven roller shaft 21.

The heating driving roller 19 includes a driving roller shaft 24 and a driving roller part 25. The driving roller shaft 24 extends in the direction of the width of the recording paper P. The driving roller part 25, which also extends in the direction of the width of the recording paper P, has the shape of a cylinder that is provided on and supported by the driving roller shaft 24 and can rotate together with the driving roller shaft 24. A plurality of (in the present embodiment, nine) heaters 26*a* to 26*i* (e.g., sheath heaters) is provided inside the driving roller shaft 24. The heaters 26*a* to 26*i* are arranged in series along the driving roller shaft 24. One end of the driving roller shaft 24 is connected to the output shaft of the driving motor 13 in such a way that the power of the driving motor 13 can be transmitted to the heating driving roller 19.

The heating driven roller 18 and the heating driving roller 19 are provided at positions at which these rollers 18 and 19 can pinch the recording paper P. As a result of the rotation of the driven roller part 22 of the heating driven roller 18 as a follower when the heating driving roller 19 rotates in a state in which the recording paper P is pinched between the heating driven roller 18 and the heating driving roller 19, the heating roller unit 17 transports the recording paper P to the paper-eject port. The heating driven roller 18 and the heating driving roller 19 serve as a pair of heating rollers that transports the recording paper P by rotating while being in contact with the recording paper P (recording target medium) in such a way that the pair of rollers can apply heat to the recording paper P.

A heater driver 27 is electrically connected to the heaters 23*a* to 23*i* of the heating driven roller 18. The heater driver 27 is used for switching between an electrified state (state in which heat will be generated) and a non-electrified state (state in which heat will not be generated) of the heaters 23*a* to 23*i*. In like manner, a heater driver 28 is electrically connected to the heaters 26*a* to 26*i* of the heating driven roller 19. The heater driver 28 is used for switching between an electrified state (state in which heat will be generated) and a non-electrified state (state in which heat will not be generated) of the heaters 26*a* to 26*i*. In the present embodiment of the invention, the temperature of each of the heaters 23*a* to 23*i* and 26*a* to 26*i* is adjusted on the basis of the length of time of electric current application.

When a current is applied to each of some of the heaters 23*a* to 23*i* and 26*a* to 26*i*, the regions of the driven roller part 22 and the driving roller part 25 that correspond to these heaters 23*a* to 23*i* and 26*a* to 26*i* are heated in the heating driven roller 18 and the heating driving roller 19, respectively. That is, the roller face of the heating driven roller 18 is divided into the plurality of regions corresponding to the plurality of heaters 23*a* to 23*i* in the direction of the shaft. The roller face of the heating driving roller 19 is divided into the plurality of regions corresponding to the plurality of heaters 26*a* to 26*i* in the direction of the shaft. In a state in which the recording paper P is pinched between the heating driven roller 18 and the heating driving roller 19, heat is applied to some regions of the recording paper P, specifically, paper regions that are in contact with the heated regions of the driven roller part 22 and the driving roller part 25, for drying the recording paper P. In this respect, the heating driven roller 18 and the heating driving roller 19 serve as a heating means, which heats the recording paper P at a position downstream of the recording head 15 in the direction of the transportation of the recording paper P.

In addition, the printer 11 is provided with a control unit 29, which is electrically connected to the recording head 15 and the heater driver 27. The control unit 29 includes a memory unit (not shown) and a CPU (not shown). Information can be written into and read out of the memory unit. The CPU, which functions as a central processing unit, performs various arithmetical operations. Information such as image data that will be outputted to the recording head 15 is stored in the memory unit. In addition, programs that are necessary when the control unit 29 performs various arithmetical operations are stored in the memory unit. The control unit 29 controls the recording head 15. In addition, the control unit 29 controls the heat generation state of each of the heaters 23*a* to 23*i* and 26*a* to 26*i* by outputting a driving control signal to each of the heater drivers 27 and 28. As described above, in the present embodiment of the invention, heat applied to the recording paper P (recording target medium) is controlled through the control of the heat generation state of each of the heaters (a plurality of heat generators) 23*a* to 23*i* and 26*a* to 26*i* by the control unit 29.

Figure 4:
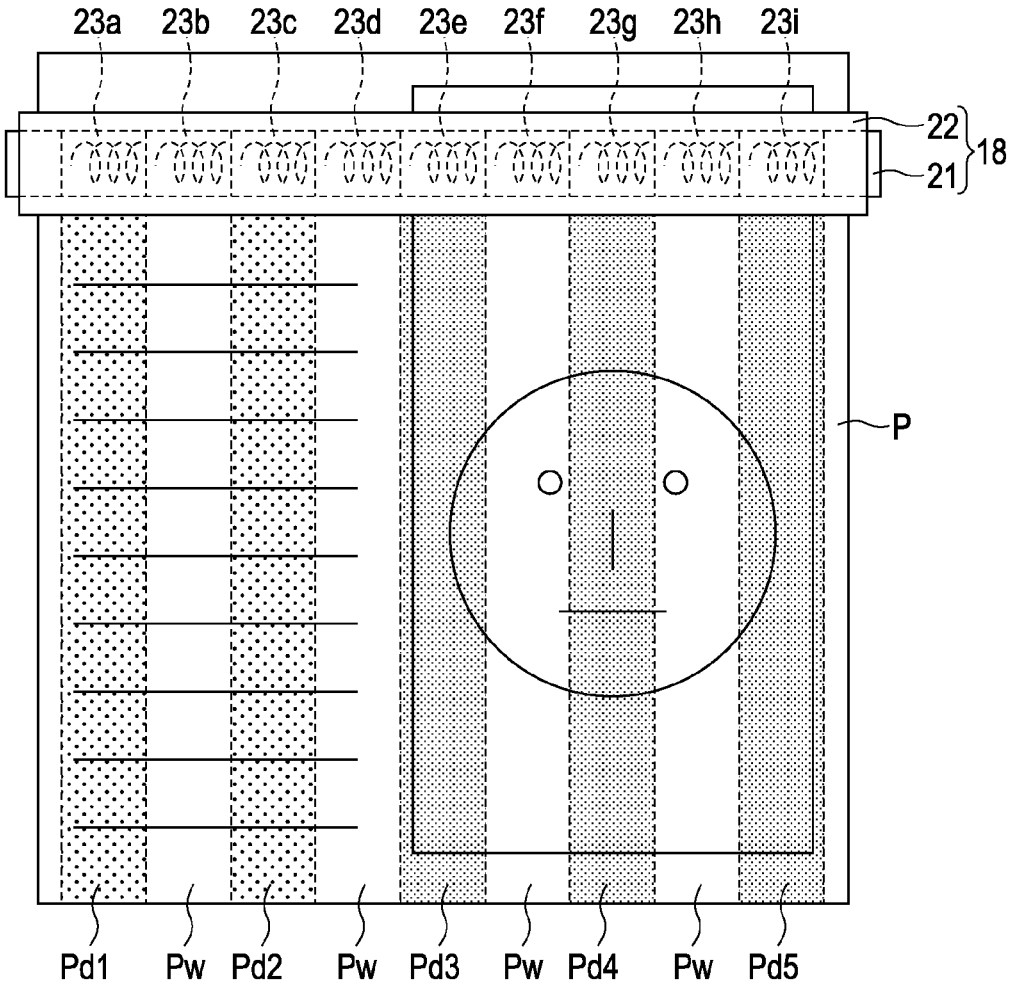
FIG. 4 is a diagram that schematically illustrates an example of drying on the basis of image data for a print image according to the first embodiment of the invention.

Next, the operation of the printer 11 having the above structure will now be explained with a focus on the operation of the heating roller unit 17. The following example is taken in the present embodiment of the invention: as illustrated in FIG. 4, characters are printed on almost the left half of the print area of the recording paper P (hereinafter referred to as the left "half" of the print area of the recording paper P, though not exactly), whereas image data for printing a photograph image on almost the right half of the print area of the recording paper P (the same holds true for the right half) is inputted into the control unit 29.

When the recording operation of the printer 11 according to the present embodiment of the invention starts, as a first step, image data is inputted into the control unit 29 from a computer that is not illustrated in the drawing. Next, the driving motor 13 operates to transport the recording paper P from the upstream side to the downstream side in the transportation direction. At the same time, on the basis of inputted image data, the corresponding heaters of the heating roller unit 17 are operated to generate heat and, in addition, a driving control signal is inputted into each of the heater drivers 27 and 28 to adjust the temperature of each heater. The pair of paper-feed rollers 12 transports the recording paper P from the upstream side to the downstream side in the transportation direction.

Next, the recording head 15 ejects ink onto the recording paper P on the basis of image data when the recording paper P passes under the recording head 15, thereby printing an image on the front (upper surface) of the recording paper P.

After the above recording operation of the recording head 15, the recording paper P is transported to the heating roller unit 17. While being pinched between the rollers of the heating roller unit 17 with heat applied to both of the surfaces thereof, the recording paper P is transported to the further downstream side. Thereafter, the recording paper P is ejected from the paper-eject port (not shown) to the outside of the printer 11.

The heaters 23*a*, 23*c*, 23*e*, 23*g*, and 23*i* are generating heat in the heating driven roller 18 of the heating roller unit 17. The heaters 26*a*, 26*c*, 26*e*, 26*g*, and 26*i* are generating heat in the heating driving roller 19 thereof. That is, in the heating driven roller 18 and the heating driving roller 19, heating areas (first areas) at each of which heat is applied to the recording paper P and non-heating areas (second areas) at each of which heat is not applied to the recording paper P are formed next to one another in an alternate pattern along the direction of the shafts thereof. Therefore, as illustrated in FIG. 4, dried areas Pd (Pd1 to Pd5) and non-dried areas Pw are formed alternately in the width direction in the recording paper P that has passed through the heating roller unit 17.

The recording paper P according to the present embodiment of the invention is a porous material that has liquid-absorbing property and has a mesh structure of pulp fiber that is made of wood (the chief constituent of the pulp fiber is cellulose; hereinafter referred to as "cellulose fiber"). Therefore, when an ink solvent (moisture or an organic solvent such as alcohol) permeates after the landing of ink droplets on the recording paper P, the cellulose fiber swells inside the recording paper P. Then, the cellulose fiber contracts when the ink solvent evaporates. Therefore, since the non-dried areas Pw of the recording paper P become deformed, the recording paper P becomes corrugated in the direction of the width thereof.

In the heating driven roller 18, the temperature of the heaters 23*e*, 23*g*, and 23*i*, which are located in the right half of the print area of the recording paper P, that is, the areas where a photograph image is printed, is set higher than the temperature of the heaters 23*a* and 23*c*, which are located in the left half of the print area of the recording paper P, that is, the areas where characters are printed. As in the heating driven roller 18, in the heating driving roller 19, the temperature of the heaters 26*e*, 26*g*, and 26*i*, which are located in the right half of the print area of the recording paper P, is set higher than the temperature of the heaters 26*a* and 26*c*, which are located in the left half of the print area of the recording paper P. In other words, the control unit 29 controls the temperature of the corresponding heaters in such a way that heat applied by the heating driven roller 18 and the heating driving roller 19 to the areas of the recording paper P with a relatively large amount of ink is higher than heat applied by the heating driven roller 18 and the heating driving roller 19 to the areas of the recording paper P with a relatively small amount of ink. Therefore, the areas Pd3, Pd4, and Pd5, that is, the areas where a photograph image is printed on the surface of the recording paper P with the use of a relatively large amount of ink, can be dried efficiently.

In addition, the temperature of the heaters 23*a*, 23*c*, 23*e*, 23*g*, and 23*i* of the heating driven roller 18 is set higher than that of the heaters 26*a*, 26*c*, 26*e*, 26*g*, and 26*i* of the heating driving roller 19 provided opposite thereto. That is, the control unit 29 controls the temperature of the corresponding heaters in such a way that heat applied by the heating driven roller 18 to the front (upper surface) of the recording paper P, in other words, the surface onto which ejected ink droplets have landed, is higher than heat applied by the heating driving roller 19 to the back (lower surface) of the recording paper P, that is, the surface opposite to the ink-side surface. Thus, it is possible to dry the front (upper surface) of the recording paper P, which is in contact with the heating driven roller 18 and is wet with ink, efficiently.

The present embodiment of the invention offers the following advantages.

(1) Heat applied to the front (upper surface) and the back (lower surface) of the recording paper P is in non-uniform distribution in the direction of the width thereof, which is perpendicular to the direction of the transportation thereof. Therefore, it is possible to make the levels of dryness of the recording paper P different in the direction of the width thereof. Therefore, the recording paper P becomes corrugated in the direction of the width thereof. By this means, it is possible to avoid the recording paper P from curling, or reduce a curl, in the direction of the transportation thereof.

(2) Since the heating driven roller 18 and the heating driving roller 19, which transport the recording paper P, apply heat to the recording paper P, a space for providing a dedicated means for heating the recording paper P is not necessary. Therefore, it is possible to reduce the size of the ink-jet printer 11.

(3) Since the control unit 29 controls heat applied to the front (upper surface) and the back (lower surface) of the recording paper P by controlling the heat generation state of the plurality of heaters 23*a* to 23*i* and 26*a* to 26*i*, it is possible to control a difference in the levels of dryness of the recording paper P in the direction of the width thereof. By this means, it is possible to reduce the curling of the recording paper P in the direction of the transportation thereof more effectively.

(4) In each of the heating driven roller 18 and the heating driving roller 19, heat control is carried out at heating areas (first areas) at each of which heat is applied to the recording paper P and at non-heating areas (second areas) at each of which heat is not applied to the recording paper P depending on the amount of ink ejected onto the recording paper P. Therefore, it is possible to properly control the difference in the levels of dryness of the recording paper P. By this means, it is possible to reduce the curling of the recording paper P in the direction of the transportation thereof in a drying process with proper control.

Since both surfaces of the recording paper P are subjected to drying with the recording paper P being pinched between the heating driven roller 18 and the heating driving roller 19, it is possible to make, on both surfaces, the levels of dryness of the recording paper P different in the direction of the width thereof. Moreover, since heat applied to the ink-side surface of the recording paper P, that is, the surface onto which ejected ink droplets have landed, is higher than heat applied to the surface opposite to the ink-side surface, it is possible to effectively apply heat thereto on the recording paper P for drying. By this means, it is possible to reduce the curling of the recording paper P in a drying process more effectively.

Second Embodiment

Next, with reference to FIGS. 5 and 6, a second embodiment of the present invention will now be explained. A major difference between the first embodiment of the invention and the second embodiment of the invention lies in a part of the structure of the heating roller unit 17. Except for the above difference, the structure of the second embodiment is substantially the same as that of the first embodiment. Therefore, the following description is focused on differences between the first embodiment of the invention and the second embodiment of the invention. Note that the same reference numerals are consistently used for components that are the same as those of a printer according to the first embodiment of the invention to avoid redundant explanation.

Figure 5:
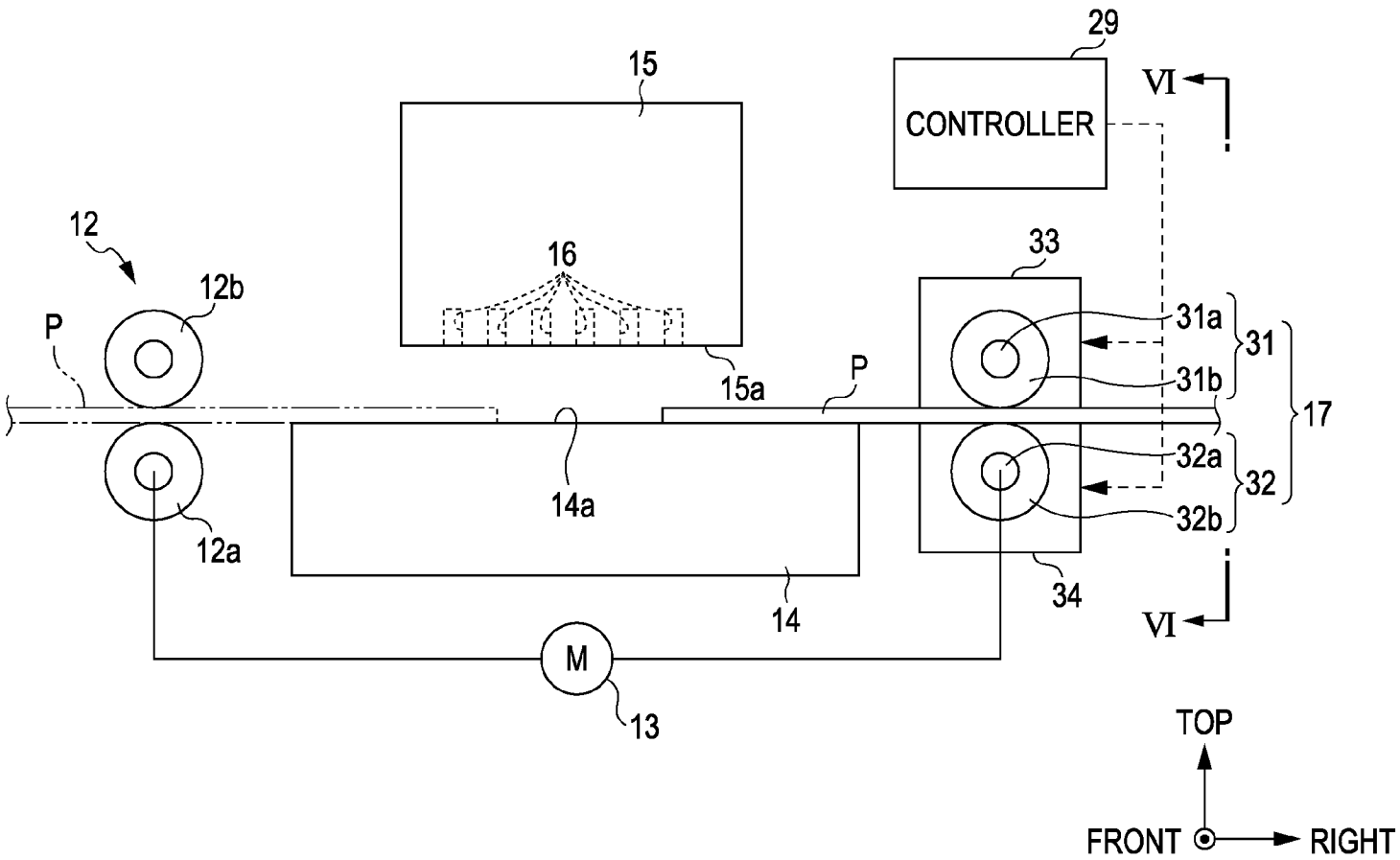
FIG. 5 is a front view that schematically illustrates an example of the structure of a printer according to a second embodiment of the invention.
Figure 6:
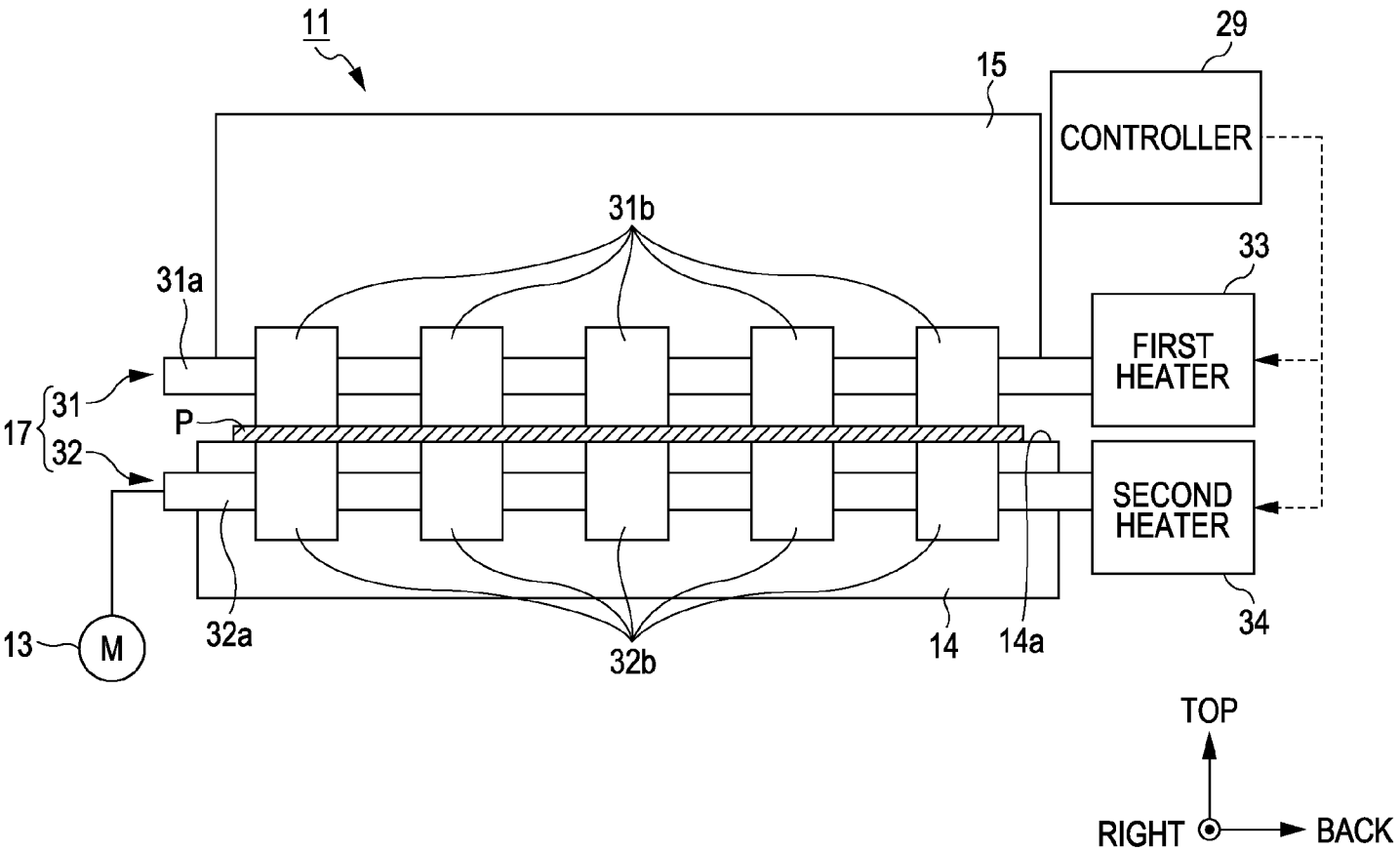
FIG. 6 is a sectional view taken along the line VI-VI of FIG. 5.

As illustrated in FIGS. 5 and 6, the heating roller unit 17 according to the present embodiment of the invention includes a heating driven roller 31 as a first roller and a heating driving roller 32 as a second roller. The front (upper surface) of the recording paper P, that is, the surface on which the image has been printed, is brought into contact with the heating driven roller 31 during transportation. The back (lower surface) of the recording paper P, that is, the surface opposite to the recorded surface, is brought into contact with the heating driving roller 32 during transportation.

As illustrated in FIG. 6, the heating driven roller 31 includes a driven roller shaft 31*a* and a plurality of driven roller body parts 31*b*. The driven roller shaft 31*a* extends in the forward/backward direction. Each of the plurality of driven roller body parts 31*b* is a columnar member that is provided on and supported by the driven roller shaft 31*a*. The driven roller body parts 31*b* are provided on and supported by the driven roller shaft 31*a* at predetermined intervals along the direction of the driven roller shaft 31*a* in such a way that the driven roller body parts 31*b* can rotate together with the driven roller shaft 31*a*. A first heater 33 that heats the driven roller shaft 31*a* is connected to one end of the driven roller shaft 31*a*. The first heater 33 applies heat to the driven roller shaft 31*a*. As a result of the application of heat to the driven roller shaft 31*a*, the driven roller body parts 31*b*, which are provided on and supported by the driven roller shaft 31*a*, are heated indirectly.

The heating driving roller 32 includes a driving roller shaft 32*a* and a plurality of driving roller body parts 32*b*. The driving roller shaft 32*a* extends in the forward/backward direction. Each of the plurality of driving roller body parts 32*b* is a columnar member that is provided on and supported by the driving roller shaft 32*a*. The driving roller body parts 32*b* are provided on and supported by the driving roller shaft 32*a* at predetermined intervals along the direction of the driving roller shaft 32*a* in such a way that the driving roller body parts 32*b* can rotate together with the driving roller shaft 32*a*. As in the structure of the heating driven roller 31, a second heater 34 that heats the driving roller shaft 32*a* is connected to one end of the driving roller shaft 32*a*. The second heater 34 applies heat to the driving roller shaft 32*a*. As a result of the application of heat to the driving roller shaft 32*a*, the driving roller body parts 32*b*, which are provided on and supported by the driving roller shaft 32*a*, are heated indirectly.

The other end of the driving roller shaft 32*a* is connected to the output shaft of the driving motor 13 in such a way that the power of the driving motor 13 can be transmitted to the heating driving roller 32. As described above, the driven roller shaft 31*a* of the heating driven roller 31 and the driving roller shaft 32*a* of the heating driven roller 32 function as the shafts of a pair of heating rollers. In addition, the plurality of driven roller body parts 31*b* of the heating driven roller 31 and the plurality of driving roller body parts 32*b* of the heating driving roller 32 function as the roller body parts of the pair of heating rollers with which the respective surfaces of the recording paper P are brought into contact.

The plurality of driven roller body parts 31*b* of the heating driven roller 31 and the plurality of driving roller body parts 32*b* of the heating driving roller 32 are arranged opposite to each other in each pair on the driven roller shaft 31*a* and the driving roller shaft 32*a* respectively with the recording paper P therebetween. The plurality of driven roller body parts 31*b* and the plurality of driving roller body parts 32*b* are aligned in the shaft direction. As a result of the rotation of the plurality of driven roller body parts 31*b* each as a follower when the plurality of driving roller body parts 32*b* rotates in a state in which the recording paper P is pinched between the driven roller body parts 31*b* and the driving roller body parts 32*b*, the heating roller unit 17 transports the recording paper P to the paper-eject port. In a state in which the recording paper P is pinched therebetween, heat is applied to some regions of the recording paper P, specifically, paper regions that are in contact with the driven roller body parts 31*b* and the driving roller body parts 32*b*, for drying the recording paper P. In addition, the temperature of the first heater 33 can be set higher than the temperature of the second heater 34 through the control of the control unit 29.

Next, the operation of the printer 11 having the above structure will now be explained with a focus on the operation of the heating roller unit 17.

When the recording operation of the printer 11 starts, for example, the paper-feed driving roller 12*a* of the pair of paper-feed rollers 12 and the heating driving roller 32 of the heating roller unit 17 rotate as driven by the driving motor 13. In addition, each of the heating driven roller 31 and the heating driving roller 32 is heated. The pair of paper-feed rollers 12 transports the recording paper P from the upstream side to the downstream side in the direction of the transportation of the recording paper P.

Next, the recording head 15 ejects ink onto the recording paper P when the recording paper P passes under the recording head 15, thereby printing an image on the front (upper surface) of the recording paper P.

After the above recording operation of the recording head 15, the recording paper P is transported to the heating roller unit 17. While being pinched between the plurality of driven roller body parts 31*b* of the heating driven roller 31 and the plurality of driving roller body parts 32*b* of the heating driving roller 32 with heat applied to both of the surfaces thereof, the recording paper P is transported to the further downstream side. Thereafter, the recording paper P is ejected from the paper-eject port (not shown) to the outside of the printer 11.

The heating driven roller 31 of the heating roller unit 17 has regions where the driven roller body parts 31*b*, with which the corresponding surface parts of the recording paper P are brought into contact, are arranged along the direction of the driven roller shaft 31*a* and regions between the driven roller body parts 31*b*. In like manner, the heating driving roller 32 of the heating roller unit 17 has regions where the driving roller body parts 32*b*, with which the corresponding surface parts of the recording paper P are brought into contact, are arranged along the direction of the driving roller shaft 32*a* and regions between the driving roller body parts 32*b*. That is, in the heating driven roller 31 and the heating driving roller 32, heating areas (first areas) at each of which heat is applied to the recording paper P and non-heating areas (second areas) at each of which heat is not applied to the recording paper P are formed in an alternate pattern along the direction of the shafts thereof. Therefore, dried areas and non-dried areas will be formed alternately in the width direction in the recording paper P. For this reason, the recording paper P that has passed through the heating roller unit 17 has different levels of dryness in the direction of the width thereof. Consequently, the recording paper P becomes corrugated in the direction of the width thereof.

The temperature of the first heater 33 is set higher than the temperature of the second heater 34. That is, the control unit 29 controls the temperature of the corresponding heaters in such a way that heat applied by the driven roller body parts 31*b* of the heating driven roller 31 to the front (upper surface) of the recording paper P, in other words, the surface onto which ejected ink droplets have landed, is higher than heat applied by the driving roller body parts 32*b* of the heating driving roller 32 to the back (lower surface) of the recording paper P, that is, the surface opposite to the ink-side surface. Thus, it is possible to dry the front (upper surface) of the recording paper P, which is in contact with the driven roller body parts 31*b* of the heating driven roller 31 and is wet with ink, efficiently.

The present embodiment of the invention explained above produces the following advantageous effect besides the advantageous effects (2) and (5) of the first embodiment of the invention.

(6) With the plurality of driven roller body parts 31*b* arranged at predetermined intervals along the shaft direction, the plurality of driving roller body parts 32*b* arranged at predetermined intervals along the shaft direction, the regions of the driven roller shaft 31*a* between the driven roller body parts 31*b*, and the regions of the driving roller shaft 32*a* between the driving roller body parts 32*b*, heat applied to the surfaces of the recording paper P is in non-uniform distribution in the direction of the width thereof. Therefore, it is possible to make the levels of dryness of the recording paper P different in the direction of the width thereof. By this means, it is possible to easily reduce the curling of the recording paper P in the direction of the transportation thereof in a drying process.

The foregoing embodiments of the invention may be modified as follows.

In the first embodiment of the invention, the heating roller unit 17 may include the heating driven roller 18 only or the heating driving roller 19 only. When the heating roller unit 17 includes the heating driven roller 18 only, heaters may be provided at some areas and not at the other areas for area separation. Specifically, for example, no heater may be provided at the areas corresponding to the heaters 23*b*, 23*d*, 23*f*, and 23*h*. In such a modified structure, the heaters 23*a*, 23*c*, 23*e*, 23*g*, and 23*i* only make up the heating driven roller 18.

In the first embodiment of the invention, the control unit 29 controls each heater of the heating driven roller 18 and the heating driving roller 19 on the basis of image data. However, the scope of the invention is not limited to such an exemplary configuration. For example, the control unit 29 may control each heater on the basis of the type of the recording paper P, the type of ink, or the like. The heater driver 27, 28, which is used for switching between an electrified state and a non-electrified state of each heater, may be omitted. The control unit 29, which controls temperature distribution in the direction of the width of the recording paper P, can be omitted by adopting a configuration in which heaters generate heat concurrently at the same time as the start of paper-feed operation.

In the first embodiment of the invention, the heaters of the heating driven roller 18 and the heating driving roller 19 may be arranged at predetermined intervals along the shaft direction.

In the second embodiment of the invention, the first heater 33 and the second heater 34 heat the driven roller body parts 31*b* and the driving roller body parts 32*b* through the driven roller shaft 31*a* and the driving roller shaft 32*a*, respectively. However, the scope of the invention is not limited to such an exemplary configuration. A heater that heats the driven roller body part 31*b*, 32*b* directly, for example, an infrared heater that emits infrared rays, a heater roller that is in contact with the circumferential surface of a roller body part to heat it, or the like, may be used.

In the second embodiment of the invention, the first heater 33 and the second heater 34 heat the plurality of driven roller body parts 31*b* and the plurality of driving roller body parts 32*b* at the same time. However, the scope of the invention is not limited to such an exemplary configuration. The driven roller body parts 31*b* and the driving roller body parts 32*b* may be heated non-concurrently.

The means for heating the recording paper P is not limited to the heating roller unit 17 described in the foregoing embodiments of the invention. For example, equipment that blows warm air onto the recording paper P to make it dry may be used as explained below.

Third Embodiment

With reference to FIGS. 7 to 10, a third embodiment of the present invention will now be explained. The term "forward/backward direction" that appears in the following description of this specification mean the "from-back-to-front" direction (or "from-front-to-back" direction when viewed in the reverse orientation) (front/back) (depth) shown by an arrow in each of the accompanying drawings unless otherwise specified. The terms "horizontal direction" and "vertical direction" that appear in the following description of this specification mean the leftward/rightward (left/right) direction and the upward/downward (top/bottom) direction shown by arrows in each of the accompanying drawings unless otherwise specified.

Figure 7:
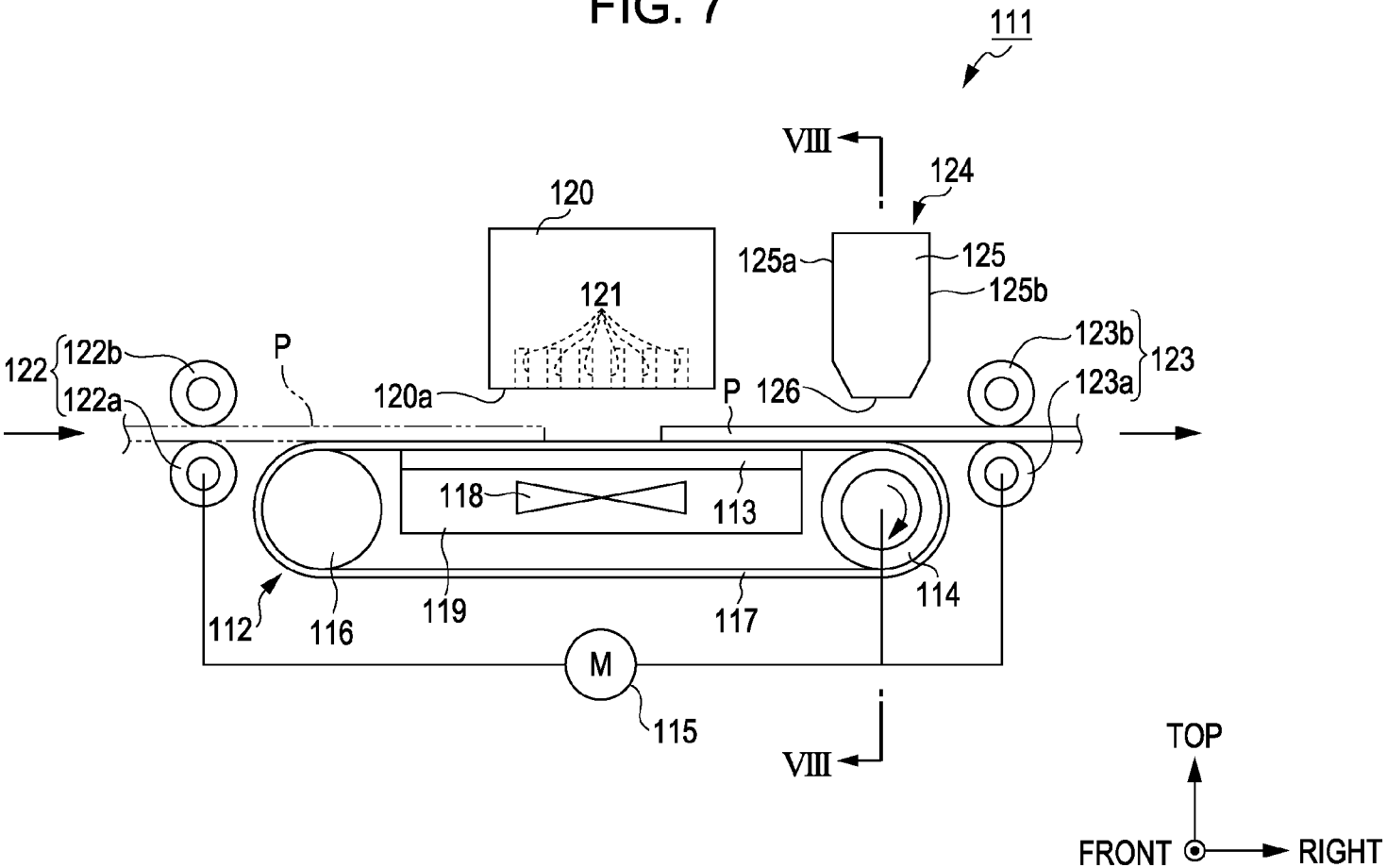
FIG. 7 is a front view that schematically illustrates an example of the structure of a printer according to a third embodiment of the invention.

As illustrated in FIG. 7, a printer 111 is equipped with a transportation unit 112 for transporting the recording paper P, which is an example of a recording (print) target medium. The transportation unit 112 includes a platen 113. The platen 113 has the shape of a rectangular plate having long sides in the direction of the width of the recording paper P (the forward/backward direction in the present embodiment), which is perpendicular to the direction of the transportation of the recording paper P. The length of the platen 113 corresponds to the maximum sheet width of the recording paper P. A driving pulley 114, which extends in the forward/backward direction, is provided to the right of the platen 113. The driving pulley 114 can rotate when driven by a driving motor 115. A driven pulley 116, which also extends in the forward/backward direction, is provided to the left of the platen 113. The driven pulley 116 can rotate around a shaft line that is parallel to the shaft line of the driving pulley 114. An endless transportation belt 117 is stretched between the driving pulley 114 and the driven pulley 116 in such a way as to enclose the platen 113. Many air holes (not shown) are formed through the transportation belt 117. When driven by the driving motor 115, the driving pulley 114 rotates clockwise as shown by a solid arrow in FIG. 7. By this means, the transportation belt 117 runs and turns clockwise.

Many suction holes (not shown) are formed through the platen 113 in a vertical direction (that is, in the direction of the thickness of the platen 113). A box-shaped suction portion 119 is provided under the platen 113. A fan 118 is provided inside the suction portion 119. The suction portion 119 encloses the opening of each of the suction holes at the lower surface of the platen 113. When the fan 118 operates, pressure inside each of the suction holes becomes negative due to airflow. As a result, a downward suction force is applied to the recording paper P placed on the transportation belt 117 through the air holes overlapping the suction holes. Therefore, in the present embodiment of the invention, the recording paper P placed on the transportation belt 117 is transported from the left, that is, the upstream side, to the right, that is, the downstream side, in a state in which the recording paper P is held on the transportation belt 117 due to suction.

A recording head 120, which is an example of a liquid ejecting head, is fixed over the platen 113 of the transportation unit 112. The recording head 120 ejects ink, which is an example of liquid, onto the (upper) surface of the recording paper P that is being transported on the transportation belt 117. The recording head 120 includes a head body having long sides in the direction perpendicular to the direction of the transportation of the recording paper P (having long sides in the forward/backward direction). The length thereof corresponds to the maximum sheet width of the recording paper P. The lower surface of the recording head 120 is a flat nozzle surface 120*a* through which a plurality of nozzles 121 for ejecting ink is formed. The nozzles 121 are arranged next to one another at equal spaces along the long sides of the recording head 120 (that is, in the forward/backward direction, which is the direction of the width of the recording paper P) to make up each of a plurality of nozzle lines (not shown). The nozzle lines are arranged next to one another at equal spaces in the direction of the transportation of the recording paper P. The recording head 120 ejects ink onto a sheet of recording paper P in synchronization with the passing of the recording paper P under the recording head 120, thereby printing an image by dot formation on the surface of the recording paper P.

A pair of upper and lower paper-feed rollers 122 is provided above the driven pulley 116, specifically, diagonally to the left thereof. The pair of paper-feed rollers 122 feeds sheets of the recording paper P onto the transportation belt 117 one at a time. The pair of paper-feed rollers 122 is made up of a paper-feed driving roller 122*a* and a paper-feed driven roller 122*b*. The paper-feed driving roller 122*a* extends in the forward/backward direction. The back (lower surface) of the recording paper P is brought into contact with the paper-feed driving roller 122*a* during transportation. The front (upper surface) of the recording paper P is brought into contact with the paper-feed driven roller 122*b* during transportation. The driving motor 115 is connected to one end of the paper-feed driving roller 122*a*. In a state in which the recording paper P is pinched between the paper-feed driving roller 122*a* and the paper-feed driven roller 122*b*, the paper-feed driven roller 122*b* rotates as a follower when the paper-feed driving roller 122*a* rotates for transporting the recording paper P.

A pair of upper and lower paper-eject rollers 123 is provided above the driving pulley 114, specifically, diagonally to the right thereof. The pair of paper-eject rollers 123 sequentially ejects sheets of the recording paper P after recording operation from the transportation belt 117. The pair of paper-eject rollers 123 is made up of a paper-eject driving roller 123*a* and a paper-eject driven roller 123*b*. The paper-eject driving roller 123*a* extends in the forward/backward direction. The back (lower surface) of the recording paper P is brought into contact with the paper-eject driving roller 123*a* during transportation. The front (upper surface) of the recording paper P is brought into contact with the paper-eject driven roller 123*b* during transportation. The driving motor 115 is connected to one end of the paper-eject driving roller 123*a*. In a state in which the recording paper P is pinched between the paper-eject driving roller 123*a* and the paper-eject driven roller 123*b*, the paper-eject driven roller 123*b* rotates as a follower when the paper-eject driving roller 123*a* rotates for transporting the recording paper P.

A drying device 124 is provided between the recording head 120 and the pair of paper-eject rollers 123 in the direction of the transportation of the recording paper P. The drying device 124 blows warm air onto the recording paper P that is wet with ink ejected from the recording head 120 to make it dry. The drying device 124 is an example of a drying means.

Next, the drying device 124 will now be explained. The drying device 124 is elongated in the direction perpendicular to the direction of the transportation of the recording paper P (elongated in the forward/backward direction). The length thereof corresponds to the maximum sheet width of the recording paper P. The drying device 124 includes a frame 125. As illustrated in FIG. 7, the frame 125 has the shape of a substantially rectangular parallelepiped. The lower part of the left sidewall 125*a* of the frame 125, that is, the upstream-side wall thereof, is bent with an inclination to the right. The lower part of the right sidewall 125*b* of the frame 125, that is, the downstream-side wall thereof, is bent with an inclination to the left. A rectangular opening 126 for blowing air (refer to FIG. 8), which is elongated in the direction of the length of the frame 125, is formed in the bottom of the frame 125.

Figure 8:
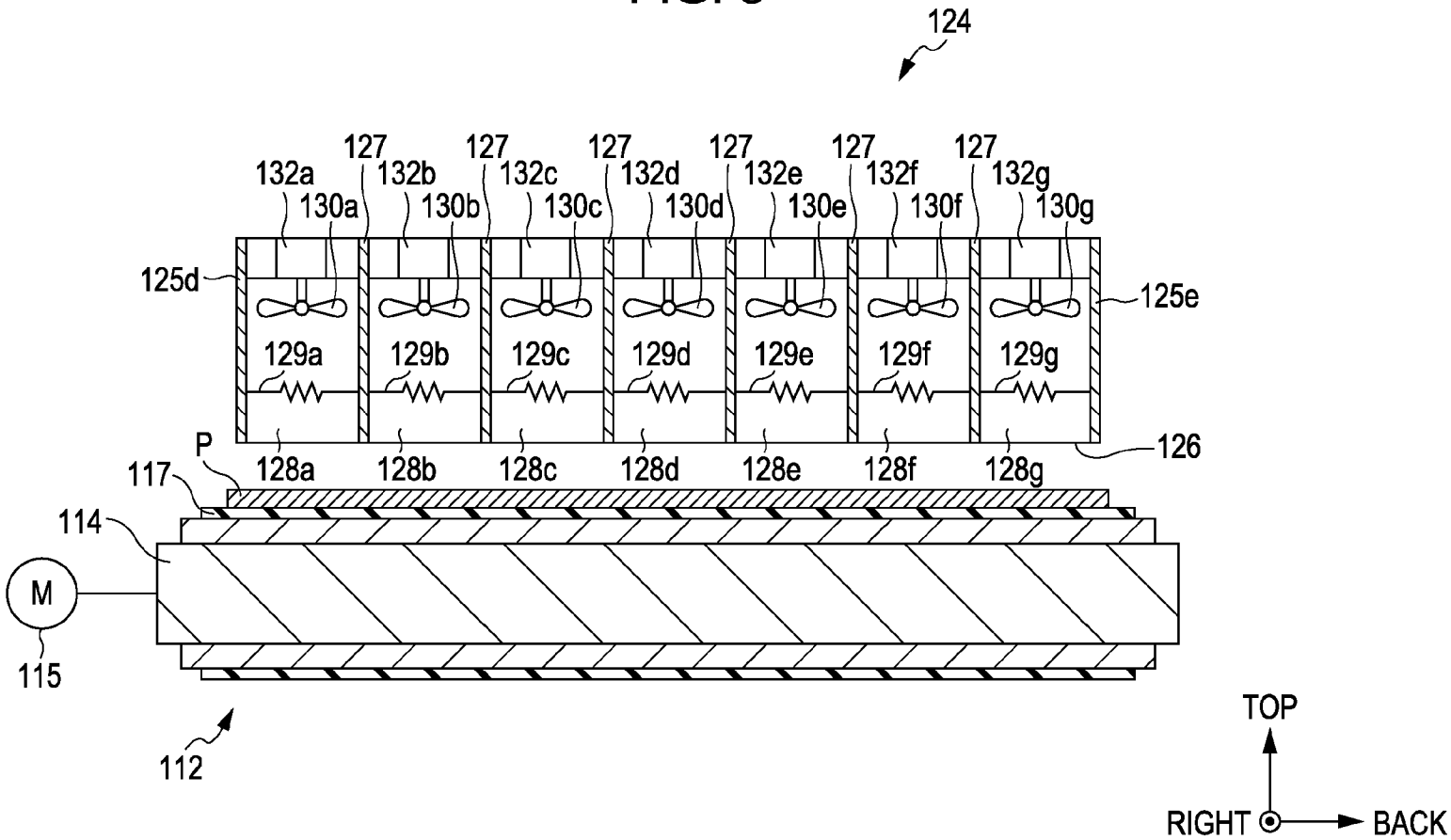
FIG. 8 is a sectional view taken along the line VIII-VIII of FIG. 7.

A plurality of partition walls 127 is formed between the left sidewall 125*a* and the right sidewall 125*b*, each of which extends in the direction of the length of the frame 125, inside the frame 125 of the drying device 124. In the present embodiment of the invention, six partition walls are formed therebetween as illustrated in FIG. 8. The partition walls 127 are formed at predetermined intervals in the direction of the length of the frame 125. With these partition walls 127, the inner space of the frame 125 is partitioned into a plurality of (in the present embodiment, seven) air-sending passages 128*a* to 128*g*. Specifically, a combination of the corresponding part of the left sidewall 125*a* of the frame 125, the corresponding part of the right sidewall 125*b* thereof, the front wall 125*d* thereof, and the partition wall 127 that is formed next to the front wall 125*d* demarcates and encloses a first air-sending passage 128*a*, which is the foremost one of the air-sending passages 128 in the width direction. In like manner, a combination of the corresponding part of the left sidewall 125*a* of the frame 125, the corresponding part of the right sidewall 125*b* thereof, and two partition walls 127 formed next to each other demarcates and encloses each of a second air-sending passage 128*b*, a third air-sending passage 128*c*, a fourth air-sending passage 128*d*, a fifth air-sending passage 128*e*, and a sixth air-sending passage 128*f*, which are the second, third, fourth, fifth, and sixth one from the front in the width direction, respectively. Finally, a combination of the corresponding part of the left sidewall 125*a* of the frame 125, the corresponding part of the right sidewall 125*b* thereof, the back wall 125*e* thereof, and the partition wall 127 that is formed next to the back wall 125*e* demarcates and encloses a seventh air-sending passage 128*g*, which is the rearmost one of the air-sending passages 128 in the width direction.

A plurality of (in the present embodiment, seven) heating members and a plurality of (in the present embodiment, seven) blowing members are provided in the plurality of air-sending passages, respectively. Specifically, as illustrated in FIG. 8, first, second, third, fourth, fifth, sixth, and seventh heaters 129*a*, 129*b*, 129*c*, 129*d*, 129*e*, 129*f*, and 129*g* (e.g., sheath heaters) and first, second, third, fourth, fifth, sixth, and seventh blower fans 130*a*, 130*b*, 130*c*, 130*d*, 130*e*, 130*f*, and 130*g* are provided in the first, second, third, fourth, fifth, sixth, and seventh air-sending passages 128*a*, 128*b*, 128*c*, 128*d*, 128*e*, 128*f*, and 128*g*, respectively. Each of the heaters 129*a* to 129*g* is provided at the lower part of the corresponding one of the air-sending passages 128*a* to 128*g*. The heaters 129*a* to 129*g* are arranged in the direction of the width of the recording paper P. A heater driver 131 (refer to FIG. 9) is electrically connected to the heaters 129*a* to 129*g*. The heater driver 131 is used for switching between an electrified state (state in which heat will be generated) and a non-electrified state (state in which heat will not be generated) of the heaters 129*a* to 129*g*.

Each of the blower fans 130*a* to 130*g* is provided at the upper part of the corresponding one of the air-sending passages 128*a* to 128*g*. First, second, third, fourth, fifth, sixth, and seventh fan motors 132*a*, 132*b*, 132*c*, 132*d*, 132*e*, 132*f*, and 132*g* are provided over the first, second, third, fourth, fifth, sixth, and seventh blower fans 130*a*, 130*b*, 130*c*, 130*d*, 130*e*, 130*f*, and 130*g*, respectively. Each of the blower fans 130*a* to 130*g* can turn in normal and reverse directions when driven by the corresponding one of the fan motors 132. A fan motor driver 133 (refer to FIG. 9) is electrically connected to the fan motors 132*a* to 132*g*. The fan motor driver 133 switches the state of the operation of each of the fan motors 132*a* to 132*g*. Each of the blower fans 130*a* to 130*g* turns in the normal direction when the corresponding one of the fan motors 132*a* to 132*g* rotates in the normal direction, thereby blowing air taken in from the outside of the drying device 124 to the recording paper P through the blowing air outlet 126 after the heating of the air by the corresponding one of the heaters 129*a* to 129*g* (as warm air). That is, the drying device 124 is configured to form a plurality of air currents by means of the air-sending passages 128*a* to 128*g* arranged in the direction of the width of the recording paper P. Each of the blower fans 130*a* to 130*g* turns in the reverse direction when the corresponding one of the fan motors 132*a* to 132*g* rotates in the reverse direction. As a result of the reverse operation, air is sucked from the vicinity of the front (upper surface) of the recording paper P through the blowing air outlet 126 and then is exhausted through the upper part of the corresponding one of the air-sending passages 128*a* to 128*g* to the outside of the drying device 124.

Figure 9:
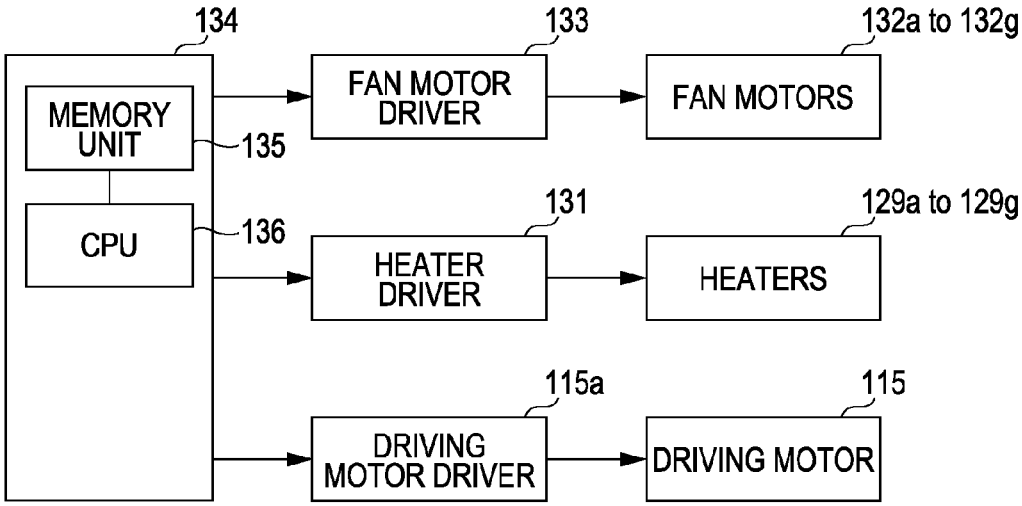
FIG. 9 is a block diagram that schematically illustrates an example of the electric configuration of a printer according to the third embodiment of the invention.

Next, the electric configuration of the printer 111 will now be explained. As illustrated in FIG. 9, the printer 111 is provided with a control unit 134. The control unit 134 controls the state of the operation of the printer 111. The control unit 134 includes a memory unit 135 and a CPU 136. Information can be written into and read out of the memory unit 135. The CPU 136, which functions as a central processing unit, performs various arithmetical operations. Various kinds of information inputted from, for example, a temperature sensor (not shown) that detects the temperature of each of the heaters 129*a* to 129*g* are stored in the memory unit 135. In addition, programs that are necessary when the control unit 134 performs various arithmetical operations are stored in the memory unit 135. A driving motor driver 115*a*, which switches the state of the operation of the driving motor 115, is electrically connected to the control unit 134. The control unit 134 controls the driving motor driver 115*a* so as to cause the driving motor 115 to rotate when the recording operation of the printer 111 starts. The driving pulley 114, which is one of the pair of pulleys around which the transportation belt 117 is stretched, rotates when driven by the driving motor 115.

The control unit 134 is electrically connected to the fan motor driver 133 and the heater driver 131. The control unit 134 controls the heat generation state of each of the heaters 129*a* to 129*g* by outputting a driving control signal to the heater driver 131 on the basis of a signal outputted from the temperature sensor (not shown). In addition, the control unit 134 controls the rotation of each of the fan motors 132*a* to 132*g* by outputting a driving control signal to the fan motor driver 133. As described above, in the present embodiment of the invention, heat applied to the recording paper P (recording target medium) is controlled through the control of the state of the heat generation of each of the heaters (a plurality of heat generators/heating members) 129*a* to 129*g* and the state of the operation of each of the blower fans 130*a* to 130*g* (a plurality of blowing members) by the control unit 134.

Next, the operation of the printer 111 having the above structure will now be explained with a focus on the operation of the drying device 124.

When the recording operation of the printer 111 according to the present embodiment of the invention starts, as a first step, the driving motor 115 operates to transport the recording paper P from the upstream side to the downstream side in the transportation direction in addition to the turning of the fan 118. At the same time, in the present embodiment of the invention, a driving control signal is inputted into the fan motor driver 133 so as to cause four odd-numbered blower fans from the front in the width direction, that is, the blower fans 130*a*, 130*c*, 130*e*, and 130*g*, which correspond respectively to four odd-numbered air-sending passages from the front in the width direction, that is, the air-sending passages 128*a*, 128*c*, 128*e*, and 128*g*, to turn. In addition, a driving control signal is inputted into the heater driver 131 so as to cause four odd-numbered heaters from the front in the width direction, that is, the heaters 129*a*, 129*c*, 129*e*, and 129*g*, which correspond respectively to four odd-numbered air-sending passages from the front in the width direction, that is, the air-sending passages 128*a*, 128*c*, 128*e*, and 128*g*, to generate heat and so as to control the temperature thereof. The pair of paper-feed rollers 122 transports the recording paper P from the upstream side to the downstream side in the transportation direction.

Next, the recording head 120 ejects ink onto the recording paper P when the recording paper P passes under the recording head 120 in the course of transportation by the transportation unit 112, thereby printing an image on the front (upper surface) of the recording paper P. Thereafter, when the recording paper P after the recording operation of the recording head 120 passes under the drying device 124, warm air is blown from the blowing air outlet 126 of the drying device 124 to the front (upper surface) of the recording paper P, that is, the surface on which the image has been printed. Then, the recording paper P with the image printed thereon is transported to the pair of paper-eject rollers 123. The recording paper P is transported to the further downstream side while being pinched between the pair of paper-eject rollers 123. Thereafter, the recording paper P is ejected from the paper-eject port (not shown) to the outside of the printer 111.

Due to the turning of the four odd-numbered blower fans 130*a*, 130*c*, 130*e*, and 130*g* from the front in the width direction and the generation of heat by the corresponding four heaters, 129*a*, 129*c*, 129*e*, and 129*g* in the drying device 124, warm air is blown from every other air-sending passage 128*a*, 128*c*, 128*e*, and 128*g* in the width direction to the recording paper P. That is, in the drying device 124, passages from each of which warm air is blown to the recording paper P for applying heat thereto and passages from each of which warm air is not blown to the recording paper P are formed next to one another in an alternate pattern along the direction of the length of the drying device 124 (in the direction of the width of the recording paper P). Therefore, the recording paper P that has passed under the drying device 124 has an alternate pattern of heated areas (first areas), which have been subjected to drying by means of heat applied due to the blowing of warm air thereto, and non-heated areas (second areas).

Figure 10A:
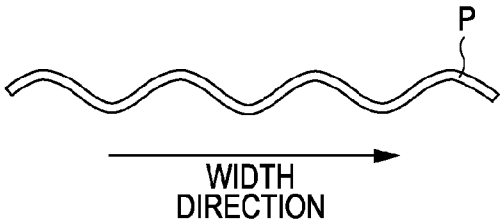
FIG. 10A is a diagram that schematically illustrates an example of paper corrugated in the width direction (cockling).
Figure 10B:
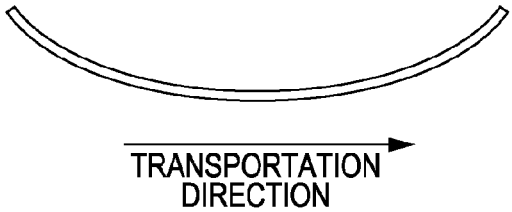
FIG. 10B is a diagram that schematically illustrates an example of paper curled in the transportation direction.

The recording paper P according to the present embodiment of the invention is a porous material that has liquid-absorbing property and has a mesh structure of pulp fiber that is made of wood (the chief constituent of the pulp fiber is cellulose; hereinafter referred to as "cellulose fiber"). Therefore, when an ink solvent (moisture or an organic solvent such as alcohol) permeates after the landing of ink droplets on the recording paper P, the cellulose fiber swells inside the recording paper P. Then, the cellulose fiber contracts when the ink solvent evaporates. Since the non-heated areas of the recording paper P become deformed during drying, as illustrated in FIG. 10A, the recording paper P becomes corrugated in the direction of the width thereof (cockling). The cockling of the recording paper P in the direction of the width thereof makes it possible to reduce the curling thereof in the direction of the transportation thereof. In contrast, if the recording paper P were dried uniformly in the direction of the width of the recording paper P, the curling of the recording paper P in the direction of the transportation thereof would occur, especially at both sides thereof, as illustrated in FIG. 10B.

Warm air blown from the four odd-numbered air-sending passages 128*a*, 128*c*, 128*e*, and 128*g* from the front in the width direction reaches the front (upper surface) of the recording paper P. Then, it flows in all directions (i.e., all around) on the front (upper surface) of the recording paper P. When the three even-numbered blower fans 130*b*, 130*d*, and 130*f* from the front in the width direction are driven to turn in the reverse direction, warm air flowing in the vicinity of the front (upper surface) of the recording paper P is sucked into the three even-numbered air-sending passages 128*b*, 128*d*, and 128*f* from the front in the width direction, which correspond respectively thereto. In this respect, the (even-numbered) air-sending passages 128*b*, 128*d*, and 128*f* serve as suction passages that are formed next to the (odd-numbered) air-sending passages 128*a*, 128*c*, 128*e*, and 128*g* (a plurality of air-sending passages) and collect warm air blown from the (odd-numbered) air-sending passages 128*a*, 128*c*, 128*e*, and 128*g*.

The present embodiment of the invention explained above produces the following advantageous effects.

(7) Heat applied to the front (upper surface) of the recording paper P that is wet with ink by means of warm air blown by the drying device 124 is in non-uniform distribution in the direction of the width thereof, which is perpendicular to the direction of the transportation thereof. Therefore, it is possible to make the levels of dryness of the recording paper P different in the direction of the width thereof. Therefore, the recording paper P becomes corrugated in the direction of the width thereof (cockling). By this means, it is possible to reduce the curling of the recording paper P in the direction of the transportation thereof in a drying process.

(8) Since the plurality of air-sending passages 128*a* to 128*g* is partitioned inside the drying device 124 by the plurality of partition walls 127, it is possible to easily form a plurality of air currents separated from one another in the direction of the width of the recording paper P.

(9) The control unit 134 controls the state of the heat generation of the plurality of heaters 129*a* to 129*g*, thereby controlling the temperature of the plurality of currents of air blown by the drying device 124 in the direction of the width of the recording paper P. In addition, the control unit 134 controls the state of the operation of the plurality of blower fans 130*a* to 130*g*, thereby controlling the flow rate (i.e., the amount of flow) of the plurality of currents of air blown by the drying device 124 in the direction of the width of the recording paper P. Therefore, it is possible to control heat applied by the plurality of currents of air blown by the drying device 124 to the front (upper surface) of the recording paper P in the direction of the width of the recording paper P. With such controlled heat application, a difference in the levels of dryness of the recording paper P can be controlled in the direction of the width thereof, which makes it possible to reduce the curling of the recording paper P in the direction of the transportation thereof.

(10) Since warm air blown from the odd-numbered air-sending passages 128*a*, 128*c*, 128*e*, and 128*g* to flow in all directions on the front (upper surface) of the recording paper P is sucked into the even-numbered air-sending passages 128*b*, 128*d*, and 128*f*, the flowing of the plurality of currents of air blown by the drying device 124 toward the recording head 120 is suppressed. Therefore, the turbulence of airflow at the recording-head (120) side is reduced on the paper transportation path. Thus, it is possible to print an image on the recording paper P with high precision.

Fourth Embodiment

Next, with reference to FIGS. 11, 12, and 13, a fourth embodiment of the present invention will now be explained. A major difference between the third embodiment of the invention and the fourth embodiment of the invention lies in the structure of the drying device 124 and the pair of paper-eject rollers 123. Except for the above difference, the structure of the fourth embodiment is substantially the same as that of the third embodiment. Therefore, the following description is focused on differences between the third embodiment of the invention and the fourth embodiment of the invention. Note that the same reference numerals are consistently used for components that are the same as those of a printer according to the third embodiment of the invention to avoid redundant explanation.

Figure 11:
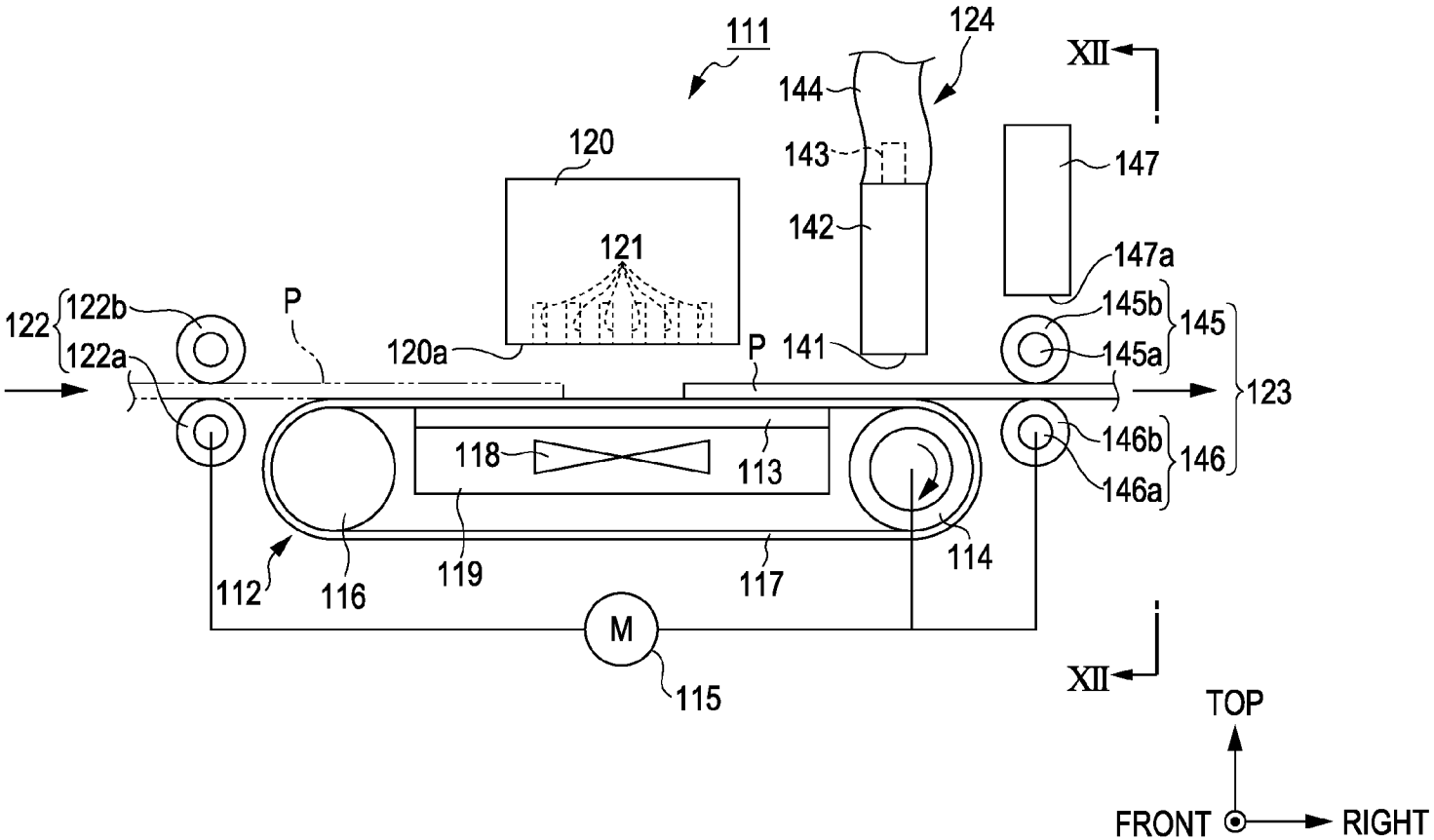
FIG. 11 is a front view that schematically illustrates an example of the structure of a printer according to a fourth embodiment of the invention.

As illustrated in FIG. 11, the drying device 124 includes a frame 142 that has a rectangular opening 141 for blowing air (refer to FIG. 13) at the bottom thereof, which faces the recording paper P. The frame 142 extends in the direction of the width of the recording paper P. The frame 142 has a rectangular shape in a plan view. A connection tube 143, which is in communication with the blowing air outlet 141, is provided as an upward protrusion at the center of the frame 142 in the forward/backward direction. The tip of a flexible duct 144 is connected to the connection tube 143. A blower fan and a heater that are not illustrated in the drawing are provided at the base end of the duct 144. That is, the drying device 124 is configured to blow warm air supplied from the duct 144 to the (upper) surface of the recording paper P that is wet with ink through the blowing air outlet 141 uniformly in the width direction for drying it.

The pair of paper-eject rollers 123 includes a paper-eject driven roller 145 and a paper-eject driving roller 146. The front (upper surface) of the recording paper P, that is, the surface on which the image has been printed, is brought into contact with the paper-eject driven roller 145 during transportation. The back (lower surface) of the recording paper P, that is, the surface opposite to the recorded surface, is brought into contact with the paper-eject driving roller 146 during transportation.

Figure 12:
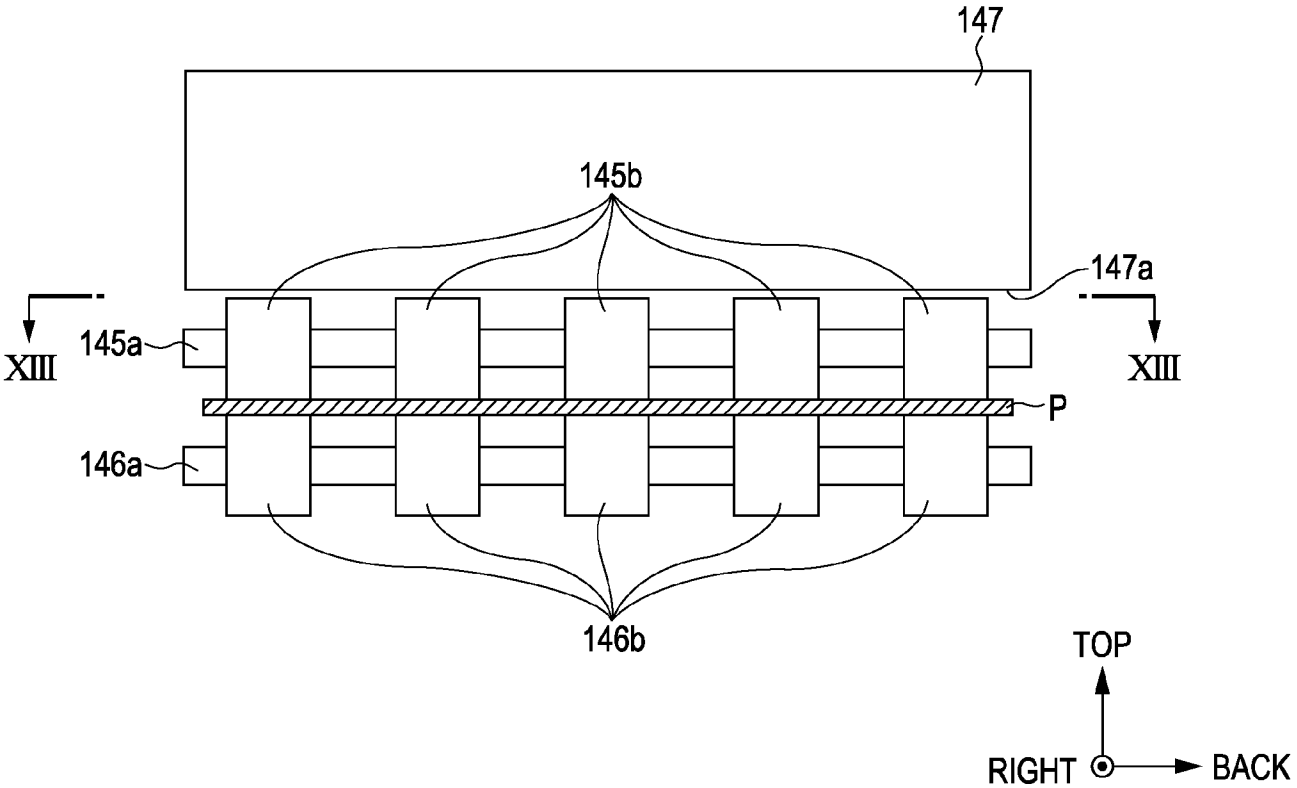
FIG. 12 is a sectional view taken along the line XII-XII of FIG. 11.
Figure 13:
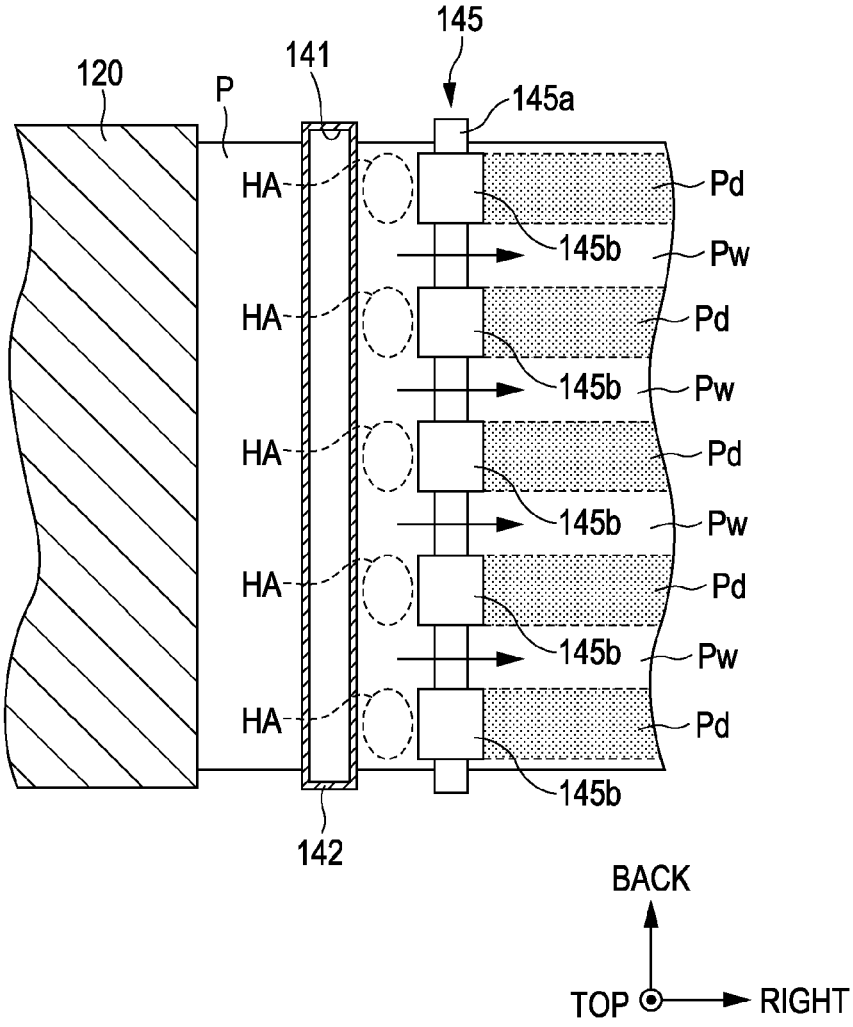
FIG. 13 is a sectional view taken along the line XIII-XIII of FIG. 12 to schematically illustrate an example of drying in the fourth embodiment of the invention.

As illustrated in FIGS. 12 and 13, the paper-eject driven roller 145 includes a driven roller shaft 145*a* and a plurality of driven roller body parts 145*b*. The driven roller shaft 145*a*, which is an example of a rotating shaft, extends in the direction of the width of the recording paper P. Each of the plurality of driven roller body parts 145*b*, which is an example of a plurality of (in the present embodiment, five) roller body members, is a columnar member that is provided on and supported by the driven roller shaft 145*a*. The driven roller body parts 145*b* are arranged in the direction of the width of the recording paper P. The driven roller body parts 145*b* are provided on and supported by the driven roller shaft 145*a* at predetermined intervals along the direction of the driven roller shaft 145*a* in such a way that the driven roller body parts 145*b* can rotate together with the driven roller shaft 145*a*.

The paper-eject driving roller 146 includes a driving roller shaft 146*a* and a plurality of (in the present embodiment, five) driving roller body parts 146*b*. The driving roller shaft 146*a* extends in the direction of the width of the recording paper P. Each of the plurality of driving roller body parts 146*b* is a columnar member that is provided on and supported by the driving roller shaft 146*a*. The driven roller body parts 146*b* are arranged in the direction of the width of the recording paper P. The driving roller body parts 146*b* are provided on and supported by the driving roller shaft 146*a* at predetermined intervals along the direction of the driving roller shaft

146*a* in such a way that the driving roller body parts 146*b* can rotate together with the driving roller shaft 146*a*. One end of the driving roller shaft 146*a* is connected to the output shaft of the driving motor 115, which drives the paper-eject driving roller 146 to rotate.

The plurality of driven roller body parts 145*b* of the paper-eject driven roller 145 and the plurality of driving roller body parts 146*b* of the paper-eject driving roller 146 are arranged opposite to each other in each pair on the driven roller shaft 145*a* and the driving roller shaft 146*a* respectively with the recording paper P therebetween. The plurality of driven roller body parts 145*b* and the plurality of driving roller body parts 146*b* are aligned in the shaft direction. As a result of the rotation of the plurality of driven roller body parts 145*b* each as a follower when the plurality of driving roller body parts 146*b* rotates in a state in which the recording paper P is pinched between the driven roller body parts 145*b* and the driving roller body parts 146*b*, the pair of paper-eject rollers 123 transports the recording paper P to the paper-eject port (not shown).

As illustrated in FIGS. 11 and 12, a partition member 147 that has the shape of a vertically long rectangle in a sectional view is provided over the pair of paper-eject rollers 123, specifically, along the paper-eject driven roller 145 of the pair of paper-eject rollers 123 in the proximity of the circumferential surface of the plurality of driven roller body parts 145*b*. Having short sides in the vertical direction and long sides in the forward/backward direction, the partition member 147 divides a space above the paper-eject driven roller 145 into a left space and a right space. The circumferential surface of the plurality of driven roller body parts 145*b* of the paper-eject driven roller 145 is not in contact with the bottom surface 147*a* of the partition member 147 during rotation.

Next, the operation of the printer 111 having the above structure will now be explained.

When the recording operation of the printer 111 starts, for example, the paper-feed driving roller 122*a* of the pair of paper-feed rollers 122, the driving pulley 114 of the transportation unit 112, and the paper-eject driving roller 146 of the pair of paper-eject rollers 123 rotate as driven by the driving motor 115. The fan 118 of the transportation unit 112 and the blower fan (not shown) of the drying device 124 are actuated. In addition, the heater (not shown) of the drying device 124 is actuated for heat generation. The pair of paper-feed rollers 122 transports the recording paper P from the upstream side to the downstream side in the direction of the transportation of the recording paper P.

Next, the recording head 120 ejects ink onto the recording paper P when the recording paper P passes under the recording head 120 in the course of transportation by the transportation unit 112, thereby printing an image on the front (upper surface) of the recording paper P. Thereafter, when the recording paper P after the recording operation of the recording head 120 passes under the drying device 124, warm air is blown from the blowing air outlet 141 of the drying device 124 to the front (upper surface) of the recording paper P, that is, the surface on which the image has been printed. Then, the recording paper P with the image printed thereon is transported to the pair of paper-eject rollers 123. The recording paper P is transported to the further downstream side while being pinched between the pair of paper-eject rollers 123. Thereafter, the recording paper P is ejected from the paper-eject port (not shown) to the outside of the printer 111.

Since the partition member 147 is provided over the paper-eject driven roller 145, warm air blown by the drying device 124 does not flow to the downstream side through the space over the paper-eject driven roller 145. Therefore, areas where warm air blown by the drying device 124 is not allowed to flow to the downstream side due to the blocking thereof by the driven roller body parts 145*b* and areas where warm air blown by the drying device 124 is allowed to flow to the downstream side, that is, areas between the driven roller body parts 145*b*, are formed in the paper-eject driven roller 145 along the direction of the driven roller shaft 145*a*. That is, as illustrated in FIG. 13, the paper-eject driven roller 145 and the partition member 147 separate warm air blown by the drying device 124 into air currents that stagnate in the neighborhood of the driven roller body parts 145*b* (first air current) and air currents that flow to the downstream side as shown by solid arrows therein (second air current).

Temperature at areas HA near the driven roller body parts 145*b*, which are areas where air currents stagnate, is higher than temperature at areas between the driven roller body parts 145*b*. That is, heat applied by air currents that stagnate to the recording paper P is higher than heat applied by air currents that flow to the downstream side to the recording paper P. For this reason, areas that are dried well (first areas) Pd and areas that are not dried well (second areas) Pw will be formed alternately in the width direction in the recording paper P. Therefore, as illustrated in FIG. 10A, the recording paper P passing through the pair of paper-eject rollers 123 becomes corrugated in the direction of the width thereof (cockling).

The present embodiment of the invention explained above produces the following advantageous effect besides an advantageous effect of the third embodiment of the invention.

(11) The paper-eject driven roller 145 and the partition member 147 separate warm air blown by the drying device 124 into air currents that are not allowed to flow to the downstream side and thus stagnate in the neighborhood of the driven roller body parts 145*b* and air currents that pass through areas between the driven roller body parts 145*b* to flow to the downstream side. Since heat applied by air currents that stagnate to the recording paper P is different from heat applied by air currents that flow to the downstream side to the recording paper P, the surface of the recording paper P is in non-uniform heat distribution in the direction of the width thereof. Therefore, since the levels of dryness of the recording paper P can be made different in the direction of the width thereof easily, it is possible to easily reduce the curling of the recording paper P in the direction of the transportation thereof in a drying process.

The third and fourth embodiments of the invention may be modified as follows.

In the third embodiment of the invention, one air-sending passage (128*a* to 128*g*) is allocated to each of the first areas and the second areas next thereto in the width direction. However, the scope of the invention is not limited to such an exemplary structure. For example, two air-sending passages arranged next to each other may be allocated to each of the first areas and the second areas next thereto in the width direction.

In the third embodiment of the invention, a cover that can open and close the blowing air outlet (opening) of the plurality of air-sending passages may be provided.

In the third embodiment of the invention, some of the air-sending passages 128 of the drying device 124 are used as suction passages. However, the scope of the invention is not limited to such an exemplary structure. For example, suction passages that do not constitute a part of the drying device 124 may be provided. It is not always necessary to provide suction passages.

In the third embodiment of the invention, the blower fans 130*a* to 130*g* may not be capable of turning in normal and reverse directions. The blower fans may be provided in not all but some of the air-sending passages. The blower fans may be replaced with a single blower fan that can send air to all of the air-sending passages.

In the third embodiment of the invention, the heaters may be provided in not all but some of the air-sending passages. Air heated by a single heater may be supplied to the plurality of air-sending passages.

In the third embodiment of the invention, the control unit 134 may control each of the heaters 129*a* to 129*g* and the blower fans 130*a* to 130*g* of the drying device 124 on the basis of, for example, the type of image data, the type of the recording paper P, the type of ink, or the like. By this means, since the temperature of each of the heaters 129*a* to 129*g* as well as the rotation of each of the fan motors 132*a* to 132*g* and the resultant rate of flow can be controlled on the basis of the amount of ink ejected to the recording paper P, the type of the recording paper P (e.g., glossy paper, Japanese paper), the type of ink (e.g., dye ink, pigment ink), or the like, it is possible to dry the recording paper P efficiently.

In the third embodiment of the invention, the heater driver 131, which is used for switching between an electrified state and a non-electrified state of each of the heaters 129*a* to 129*g*, may be omitted. In the third embodiment of the invention, the fan motor driver 133, which is used for switching the state of the operation of each of the fan motors 132*a* to 132*g*, may be omitted. The control unit 134, which controls temperature distribution and flow-rate distribution in the direction of the width of the recording paper P, can be omitted by adopting a configuration in which the heaters 129*a* to 129*g* generate heat concurrently at the same time as the start of paper-feed operation and which the blower fans 130*a* to 130*g* are actuated concurrently at the same time as the start of paper-feed operation.

In the third embodiment of the invention, the plurality of air-sending passages of the drying device 124 may be arranged at predetermined intervals in the direction of the width of the recording paper P.

In the fourth embodiment of the invention, the partition member 147 is oriented perpendicular to the paper-eject driven roller 145. However, the scope of the invention is not limited to such an exemplary structure. For example, the partition member 147 may be inclined toward the upstream side or the downstream side.

In the fourth embodiment of the invention, the surface of the partition member 147 is not limited to a flat and level surface. For example, it may be curved or sloped. The shape of the partition member 147 is not limited to a vertically long rectangle in a sectional view. For example, it may be a circle, a polygon, or a plate. The partition member 147 may be a roller member that is in contact with the plurality of driven roller body parts 145*b* of the paper-eject driven roller 145 and can rotate when the driven roller body parts 145*b* rotate.

In the third and fourth embodiments of the invention, an air screen member that has long sides in the direction of the width of the recording paper P, which is perpendicular to the direction of the transportation of the recording paper P, and partially blocks the flow of warm air from the drying device 124 to the recording head 120 may be provided at a position downstream of the recording head 120 but upstream of the drying device 124 in the transportation direction. With such a structure, since the flowing of warm air blown by the drying device 124 toward the recording head 120 is suppressed, it is possible to print an image on the recording paper P with high precision.

In the foregoing embodiments of the invention, it is assumed that the recording paper P has a cut-sheet shape. However, the scope of the invention is not limited thereto. For example, the recording paper P may be long paper such as continuous form paper.

An ink-jet printer is taken as an example of a liquid ejecting apparatus in the foregoing description of exemplary embodiments of the invention. However, the scope of the invention is not limited to an ink-jet printer. The invention can be applied to various liquid ejecting apparatuses that eject or discharge various kinds of liquid that include ink but not limited thereto. It can be applied to various micro-drop liquid ejecting apparatuses that are provided with micro-drop liquid ejecting heads for discharging liquid drops whose amount is very small. Herein, a "liquid droplet" is a form or a state of liquid in the process of ejection of the liquid from a liquid ejecting apparatus. The liquid droplet encompasses, for example, a particulate droplet, a tear-shaped droplet, and a viscous/thready droplet that forms a thread tail, without any limitation thereto. The "liquid" may be made of any material as long as a liquid ejecting apparatus can eject it. The liquid may be any substance as long as it is in a liquid phase. It may have high viscosity or low viscosity. It may be sol or gel water. Or, it may be fluid that includes, without any limitation thereto, inorganic solvent, organic solvent, solution, liquid resin, and liquid metal (e.g., metal melt). The "liquid" is not limited to liquid as a state of a substance. It encompasses a liquid/liquefied matter/material that is made as a result of dissolution, dispersion, or mixture of particles of a functional material made of a solid such as pigment, metal particles, or the like into/with a solvent, though not limited thereto. Besides ink explained in the foregoing exemplary embodiments, liquid crystal is a typical example of the liquid. The term "ink" encompasses various types of ink having various liquid compositions such as popular water-based ink, oil-based ink, gel ink, hot melt ink, or the like. Examples of various liquid ejecting apparatuses are: an apparatus that ejects liquid in which, for example, a material such as an electrode material, a color material, or the like that is used in the production of a liquid crystal display device, an organic EL (electroluminescence) display device, a surface/plane emission display device, a color filter, or the like is dispersed or dissolved, an apparatus that ejects a living organic material that is used for production of biochips, an apparatus that is used as a high precision pipette and ejects liquid as a sample, a textile printing apparatus, a micro dispenser, and the like. In addition, the invention is applicable to a liquid ejecting apparatus that ejects, with high precision, lubricating oil onto a precision instrument and equipment including but not limited to a watch and a camera. Moreover, the invention is applicable to a liquid ejecting apparatus that ejects liquid of a transparent resin such as an ultraviolet ray curing resin or the like onto a substrate so as to form a micro hemispherical lens (optical lens) that is used in an optical communication element or the like. Furthermore, the invention is applicable to a liquid ejecting apparatus that ejects an etchant such as acid or alkali that is used for the etching of a substrate or the like. The scope of the application of the invention is not limited to those enumerated or explained above. The invention can be applied to various liquid ejecting apparatuses that eject or discharge various kinds of liquid.

What is claimed is:

1. A liquid ejecting apparatus that ejects liquid to a recording target medium that is transported from an upstream side to a downstream side, comprising:

a liquid ejecting head that ejects the liquid to the recording target medium for recording; and a heating section that heats the recording target medium at a downstream position in a transportation direction of the recording target medium, wherein the heating section is disposed along a width direction of the recording target medium, which intersects with the transportation direction thereof, the heating section is divided into a plurality of areas in the width direction, and heat applied by first areas of the plurality of areas to the recording target medium is higher than heat applied by second areas, wherein the first areas and the second areas are formed next to one another in an alternating pattern along the width direction of the recording target medium, the alternating pattern being configured to reduce curling of the recording target medium in the direction of transportation and to control different levels of dryness in the recording target medium.

2. The liquid ejecting apparatus according to claim 1, wherein the heating section is a heating roller that rotates while being in contact with the recording target medium to transport the recording target medium.

3. The liquid ejecting apparatus according to claim 2, further comprising a controlling section, wherein the heating roller includes a plurality of heat generators arranged inside the heating roller in the width direction; and the controlling section controls a heat generation state of each of the plurality of heat generators in such a way as to make heat applied by the first areas different from heat applied by the second areas.

4. The liquid ejecting apparatus according to claim 3, wherein the controlling section controls the heat applied by the first areas of the heating roller and the heat applied by the second areas of the heating roller on the basis of image data for an image to be recorded on the recording target medium.

5. The liquid ejecting apparatus according to claim 2, wherein the heating roller includes a rotating shaft that is disposed along the width direction and a plurality of roller body members provided on the rotating shaft at intervals in a shaft direction for contact with the recording target medium.

6. The liquid ejecting apparatus according to claim 2, wherein the heating roller is a pair of a first roller and a second roller; a surface of the recording target medium on which the liquid has been ejected is brought into contact with the first roller; a surface opposite to the surface that is brought into contact with the first roller is brought into contact with the second roller; the recording target medium is pinched between the first roller and the second roller for transportation when in contact therewith; and heat applied by the first roller to the recording target medium is higher than heat applied by the second roller to the recording target medium.

7. The liquid ejecting apparatus according to claim 2, wherein the heating roller includes a heat generator inside the heating roller at the first area.

8. The liquid ejecting apparatus according to claim 1, wherein the heating section is a drying device that blows warm air to a surface of the recording target medium that is wet with the liquid.

9. The liquid ejecting apparatus according to claim 8, wherein the drying device includes a plurality of air-sending passages for separating the warm air into a plurality of air currents corresponding to the plurality of areas.

10. The liquid ejecting apparatus according to claim 9, further comprising a controlling section that controls the drying device in such a way as to make heat applied by first air currents of the plurality of air currents blown from the plurality of air-sending passages to the first areas different from heat applied by second air currents thereof to the second areas.

11. The liquid ejecting apparatus according to claim 10, wherein the drying device includes a plurality of heating members corresponding to the plurality of air-sending passages; and the controlling section controls amount of heat generation of the plurality of heating members.

12. The liquid ejecting apparatus according to claim 10, wherein the drying device includes a plurality of blowing members corresponding to the plurality of air-sending passages; and the controlling section controls operation of the plurality of blowing members.

13. The liquid ejecting apparatus according to claim 9, further comprising a suction passage that is provided adjacent to the plurality of air-sending passages so as to collect the warm air blown from the plurality of air-sending passages.

14. The liquid ejecting apparatus according to claim 8, further comprising an air screen member that is disposed along the width direction at a position downstream of the liquid ejecting head but upstream of the drying device in the transportation direction so as to partially block a flow of the warm air from the drying device to the liquid ejecting head.

15. The liquid ejecting apparatus according to claim 1, wherein the recording target medium has a first area having a large amount of ink and a second area having a small amount of ink, and wherein an amount of heat corresponding to the area that has a large amount of ink is larger than the amount of hear corresponding to the area that has the small amount of ink.

* * * * *